US005151357A

United States Patent [19]

Koide et al.

[11] Patent Number: 5,151,357

[45] Date of Patent: Sep. 29, 1992

[54] SILVER HALIDE PHOTOGRAPHIC MATERIAL

[75] Inventors: Tomoyuki Koide; Naoto Matsuda; Koki Nakamura; Tetsuro Kojima, all of Kanagawa, Japan

[73] Assignee: Fuji Photo Film Co., Ltd., Kanagawa, Japan

[21] Appl. No.: 606,279

[22] Filed: Oct. 31, 1990

[30] Foreign Application Priority Data

Nov. 1, 1989 [JP] Japan ..... 1-285154
Nov. 1, 1989 [JP] Japan ..... 1-285155

[51] Int. Cl.[5] ..... G03C 1/34

[52] U.S. Cl. ..... 430/610; 430/611; 430/613; 430/614; 430/617; 430/619

[58] Field of Search ..... 430/608, 610, 611, 613, 430/614, 598, 617, 619

[56] References Cited

U.S. PATENT DOCUMENTS

| | | | |
|---|---|---|---|
| T878,010 | 9/1970 | Beavers . | |
| 4,820,616 | 4/1989 | Matejec et al. | 430/543 |
| 4,950,578 | 8/1990 | Yagihara et al. | 430/264 |
| 4,952,483 | 8/1990 | Inoue et al. | 430/378 |
| 4,965,181 | 10/1990 | Kubodera et al. | 430/617 |

FOREIGN PATENT DOCUMENTS

| | | |
|---|---|---|
| 0302251 | 2/1989 | European Pat. Off. . |
| 3605713 | 8/1987 | Fed. Rep. of Germany . |
| 2084347 | 12/1971 | France . |
| 62-34150 | 2/1987 | Japan . |
| 1340623 | 12/1973 | United Kingdom . |

OTHER PUBLICATIONS

Patent Abstracts of Japan, vol. 11, No. 216 (Jul. 14, 1987).

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A novel silver halide photographic material is described, comprising a compound represented by formula (I):

(I)

wherein Q represents a nonmetallic atomic group required to be connected to carbon atom and nitrogen atom to form a monocyclic or condensed heterocyclic ring therewith; L represents a divalent group; n represents an integer of 0 to 2; $M^1$ represents a hydrogen atom, ammonium ion or metallic ion; and $R^1$ and $R^2$ each represents a hydrogen atom, alkyl group, ammonium ion or metallic ion and may be the same or different or may be connected to each other to form a 5- or 6-membered ring. In a preferred embodiment, at least one of $R^2$ and $R^1$ represents a hydrogen atom, ammonium ion or metallic ion.

9 Claims, No Drawings

SILVER HALIDE PHOTOGRAPHIC MATERIAL

FIELD OF THE INVENTION

The present invention relates to a silver halide photographic material which gives images with an excellent S/N ratio. More particularly, the present invention relates to a silver halide photographic material which comprises a novel antifogging agent to provide an improved S/N ratio of silver development.

BACKGROUND OF THE INVENTION

Development fog is a phenomenon in which the density on the unexposed portion of a silver halide photographic material (hereinafter simply referred to as "light-sensitive material") increases during development. The higher the sensitivity of the light-sensitive material is, the more easily occurs this phenomenon. The longer the light-sensitive material is stored, the more easily occurs this phenomenon. The higher the temperature and humidity at which the light-sensitive material is stored, the more easily occurs this phenomenon.

In order to reduce the time to completion of processing, high temperature rapid processing or high activity rapid processing is often effected to reduce the processing time. In this case, too, fog occurs quite often. Development fog causes deterioration in photographic properties such as image contrast. Therefore, it is desired to inhibit development fog as much as possible.

In order to inhibit development fog, an approach has heretofore been employed which comprises the incorporation of a so-called antifogging agent in light-sensitive materials. As such antifogging agents there have been known many compounds as disclosed in Birr, "Stabilization of Photographic Silver Halide Emulsions", Focal Press, (1974). However, there has arisen a problem that as the antifogging agent inhibits fog more strongly, it decreases sensitivity, lowering gradation, or inhibits the adsorption of a sensitizing dye, hindering color sensitization. It has been thus desired to provide a compound which inhibits fog while enabling the maintenance of sensitivity and gradation without deteriorating color sensitization.

Methods for improving an image contract in high temperature processing are disclosed, for example, in JP-A-59-168442, JP-A-59-111636, JP-A-59-177550, JP-A-60-168545, JP-A-60-180199, JP-A-60-180563, JP-A-61-53633, JP-A-62-78554, JP-A-62-123456, JP-A-63-133144, JP-A-2-44336, Japanese Patent Application No. Hei. 1-33338, but satisfactory effects were not obtained by these methods.

SUMMARY OF THE INVENTION

It is therefore an object of the present invention to provide an antifogging agent which can eliminate the foregoing disadvantages to effectively inhibit development fog while reducing the drop in sensitivity.

It is another object of the present invention to provide a silver halide photographic material which comprises such an antifogging agent to provide images with an excellent S/N ratio.

The inventors made studies to solve these problems. As a result, it was found that a novel mercapto compound containing a phosphonic acid portion as described later exhibits extremely remarkable properties and surprising effects to accomplish these objects.

The above and other objects of the present invention will become more apparent from the following detailed description and examples.

These objects of the present invention are accomplished with a silver halide photographic material comprising at least one light-sensitive silver halide emulsion layer on a support, characterized in that there is contained in said emulsion layer or its adjacent layers a compound represented by formula (I):

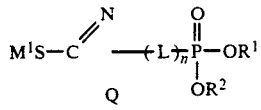

(I)

wherein Q represents a nonmetallic atomic group required to be connected to carbon atom and nitrogen atom to form a monocyclic or condensed heterocyclic ring therewith; L represents a divalent group; n represents an integer of 0 to 2; $M^1$ represents a hydrogen atom, ammonium ion or metallic ion; and $R^1$ and $R^2$ each represents a hydrogen atom, alkyl group, ammonium ion or metallic ion and may be the same or different or may be connected to each other to form a 5- or 6-membered ring.

DETAILED DESCRIPTION OF THE INVENTION

The compound represented by formula (I) will be further described hereinafter.

Q represents a nonmetallic atomic group required to be connected to the carbon atom and nitrogen atom to form a monocyclic or condensed heterocyclic ring therewith. Preferred examples of the heterocyclic ring thus formed include an imidazole ring, pyrazole ring, triazole ring, tetrazole ring, oxazole ring, thiazole ring, selenazole ring, tellurazole ring, oxadiazole ring, thiadiazole ring, pyridine ring, pyrazine ring, pyrimidine ring, and benzimidazole ring, benzothiazole ring and benzoxazole ring obtained by condensing a benzene ring with these rings. Other preferred examples of such heterocyclic rings include azaindene such as 1,3,3a,7-tetrazaindene.

L represents a divalent group. Examples of the divalent group represented by L include an alkylene group which may be substituted, arylene group which may be substituted, and heteroarylene group which may be substituted. L may be in the form of a combination of such a divalent group with another divalent group such as an ether bond (—O—), thioether bond (—S—), urethane bond (—NRCOO—), urea bond (—NRCONR—), ester bond (—COO—), amide bond (—CONR—), sulfonamide bond (—$SO_2$NR—), thiourea bond (—NRCSNR—) and carboxylic ester bond (—OCOO—).

The suffix n represents an integer of 0 to 2. When n is 0, it means that a phosphorous atom is directly connected to the heterocyclic ring formed of Q.

$M^1$ represents a hydrogen atom or cation such as ammonium ion and metallic ion, and is preferably a hydrogen atom. Examples of such an ammonium ion include $NH_4^{\oplus}$, $NH(C_2H_5)_3^{\oplus}$, and $N(C_2H_5)_4^{\oplus}$. Examples of such a metallic ion include $Na^{\oplus}$, $K^{\oplus}$, $Ag^{\oplus}$, $Li^{\oplus}$, $Ca^{\oplus\oplus}$, and $Zn^{\oplus\oplus}$.

$R^1$ and $R^2$ each represents a hydrogen atom, alkyl group which may be substituted or cation such as ammonium ion and metallic ion. Preferred among the groups represented by $R^1$ or $R^2$ are hydrogen atom and cation such as ammonium ion and metallic ion. The alkyl group represented by $R^1$ or $R^2$ preferably contains 5 or less carbon atoms. Examples of such an alkyl group include a methyl group, ethyl group, propyl group, and methoxyethyl group. $R^1$ and $R^2$ may be connected to each other to form 1,2-ethylene group or 1,3-propylene group. Examples of ammonium ion and metallic ion are as mentioned with reference to $M^1$.

The heterocyclic ring containing Q and the divalent group represented by L may contain substituents. Examples of such substituents include hydrogen atom, nitro group, nitroso group, cyano group, carboxyl group, sulfo group, mercapto group, hydroxyl group, halogen atom (e.g., fluorine, chlorine, bromine, iodine), alkyl group and, aralkyl group (e.g., alkyl group and aralkyl group which may be substituted, such as methyl, trifluoromethyl, benzyl, chloromethyl, dimethylaminomethyl, ethoxycarbonylmethyl, aminomethyl, acetylaminomethyl, ethyl, carboxyethyl, allyl, n-propyl, t-butyl, n-pentyl, cyclopentyl, n-hexyl, cyclohexyl, n-octyl, n-decyl, n-undecyl), alkenyl group (e.g., alkenyl group which may be substituted, such as vinyl, 2-chlorovinyl, 1-methylvinyl, 2-cyanovinyl, cyclohexene-1-il), alkynyl group (e.g., alkynyl group which may be substituted, such as ethynyl, 1-propynyl, 2-ethoxycarbonylethynyl), aryl group (e.g., aryl group which may be substituted, such as phenyl, naphthyl, 3-hydroxyphenyl, 3-chlorophenyl, 4-acetylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl), heterocyclic group (e.g., heterocyclic group which may be substituted, such as 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzthiazolyl, 2-benzimidazolyl, 2-benzoxazolyl, 2-oxazoline-2-il, morpholino), acyl group (e.g., acyl group which may be substituted, such as acetyl, propionyl, iso-butyloyl, 2,2-dimethylpropionyl, benzoyl, 3,4-dichlorobenzoyl, 3-acetylamino-4-methoxybenzoyl, 4-methylbenzoyl), sulfonyl group (e.g., sulfonyl group which may be substituted, such as methanesulfonyl, ethanesulfonyl, chloromethanesulfonyl, propanesulfonyl, butanesulfonyl, n-octanesulfonyl, benzenesulfonyl, 4-toluenesulfonyl), amino group (e.g., amino group which may be substituted, such as amino, methylamino, dimethylamino, ethylamino, ethyl-3-carboxypropylamino, ethyl-2-sulfoethylamino, phenylamino, methylphenylamino, methyloctylamino), alkoxy group (e.g., alkoxy group which may be substituted, such as methoxy, ethoxy, n-propyloxy, cyclohexylmethoxy), aryloxy group and heteroaryloxy group (e.g., aryloxy group and heteroaryloxy group which may be substituted, such as phenoxy, naphthyloxy, 4-acetylaminophenoxy, pyrimidine-2-iloxy, 2-pyridyloxy) alkylthio group (e.g., alkylthio group which may be substituted, such as methylthio, ethylthio, n-butylthio, n-octylthio, t-octylthio, ethoxycarbonylmethylthio, benzylthio, 2-hydroxylethylthio), arylthio group and heteroarylthio group (e.g., arylthio group and heteroarylthio group which may be substituted, such as phenylthio, 4-chlorophenylthio, 2-n-butoxy-5-t-octylphenylthio, 4-nitrophenylthio, 2-nitrophenylthio, 4-acetylaminophenylthio, 1-phenyl-5-tetrazolylthio, 5-methanesulfonylbenzothiazole-2-il), ammonio group (e.g., ammonio group which may be substituted, such as ammonio, trimethylammonio, phenyldimethylammonio, dimethylbenzylammonio), carbamoyl group (e.g., carbamoyl group which may be substituted, such as carbamoyl, methylcarbamoyl, dimethylcarbamoyl, bis(2-methoxyethyl) carbamoyl, cyclohexylcarbamoyl), sulfamoyl group (e.g., sulfamoyl group which may be substituted, such as sulfamoyl, methylsulfamoyl, dimethylsulfamoyl, bis(2-methoxyethyl)sulfamoyl, di-n-butylsulfamoyl), acylamino group (e.g., acylamino group which may be substituted, such as acetylamino, 2-carboxybenzoylamino, 3-nitrobenzoylamino, 3-diethylaminopropanoylamino, acryloylamino), acyloxy group (e.g., acyloxy group which may be substituted, such as acetoxy, benzoyloxy, 2-butenoyloxy, 2-methylpropanoyloxy), sulfonylamino group (e.g., sulfonylamino group which may be substituted, such as methanesulfonylamino, benzenesulfonylamino, 2-methoxy-5-n-methylbenzenesulfonylamino), alkoxycarbonylamino group (e.g., alkoxycarbonylamino group which may be substituted, such as methoxycarbonylamino, 2-methoxyethoxycarbonylamino, isobutoxycarbonylamino, benzyloxycarbonylamino, t-butoxycarbonylamino, 2-cyanoethoxycarbonylamino), aryloxycarbonylamino (e.g., aryloxycarbonylamino group which may be substituted, such as phenoxycarbonylamino, 2,4-nitrophenoxycarbonylamino), alkoxycarbonyloxy group (e.g., alkoxycarbonyloxy group which may be substituted, such as methoxycarbonyloxy, t-butoxycarbonyloxy, 2-benzenesulfonylethoxycarbonyloxy, benzylcarbonyloxy), aryloxycarbonyloxy group (e.g., aryloxycarbonyloxy group which may be substituted, such as phenoxycarbonyloxy, 3-cyanophenoxycarbonyloxy, 4-acetoxyphenoxycarbonyloxy, 4-t-butoxycarbonylaminophenoxycarbonyloxy), aminocarbonylamino group (e.g., aminocarbonylamino group which may be substituted, such as methylaminocarbonylamino, morpholinocarbonylamino, N-ethyl-N-phenylaminocarbonylamino, 4-methanesulfonylaminocarbonylamino), aminocarbonyloxy group (e.g., aminocarbonyloxy group which may be substituted, such as dimethylaminocarbonyloxy, pyrrolidinocarbonyloxy, 4-dipropylaminophenylaminocarbonyloxy) aminosulfonylamino group (e.g., aminosulfonylamino group which may be substituted, such as diethylaminosulfonylamino, di-n-butylaminosulfonylamino, phenylaminosulfonylamino), sulfonyloxy group (e.g., sulfonyloxy group which may be substituted, such as phenylsulfonyloxy, methanesulfonyloxy, chloromethanesulfonyloxy, 4-chlorophenylsulfonyloxy), and alkoxy or aryloxycarbonyl group (e.g., alkoxy or aryloxycarbonyl group which may be substituted, such as methoxycarbonyl, ethoxycarbonyl, phenoxycarbonyl, 2-methoxyethoxycarbonyl). Such a substituent preferably has 10 or less carbon atoms, if any.

Specific examples of the compound represented by formula (I) to be used in the present invention will be set forth below, but the present invention should not be construed as being limited thereto.

1
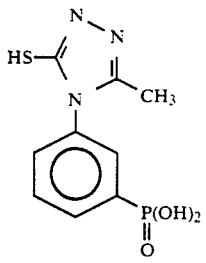
2
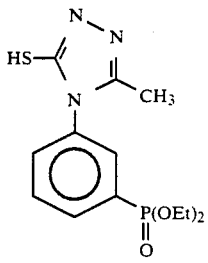
3
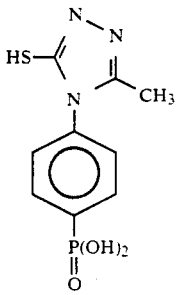
4
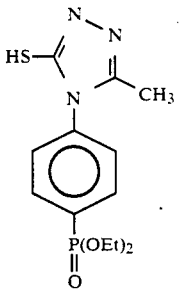
5
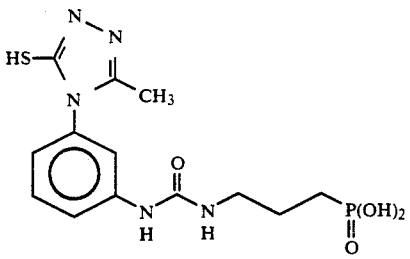
6
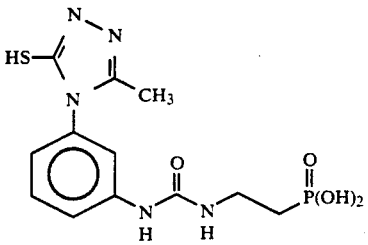
-continued
7
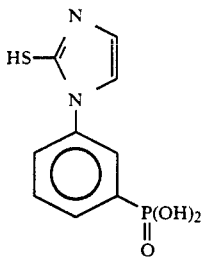
8
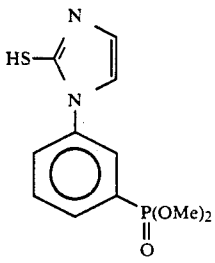
9
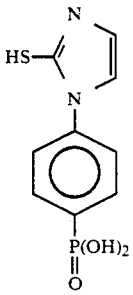
10
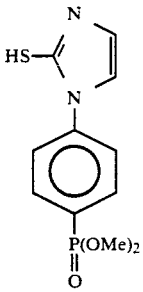
11
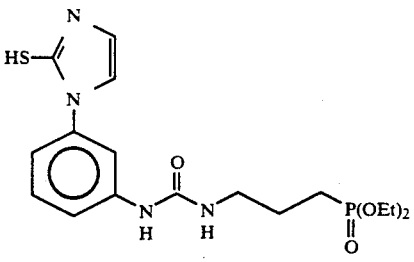
12
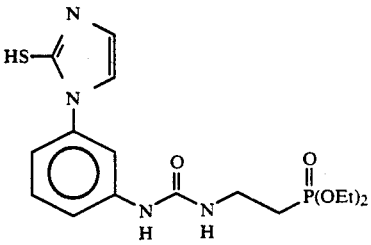

-continued
13
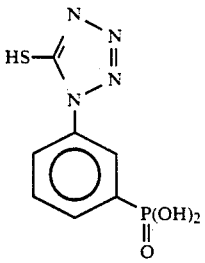
14
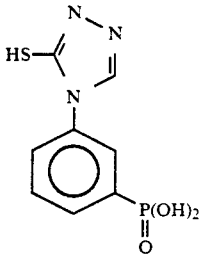
15
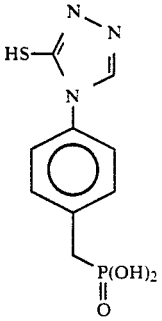
16
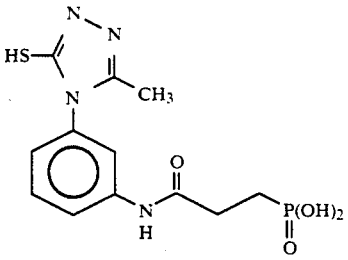
17
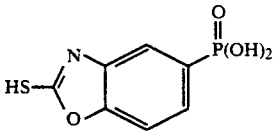
18
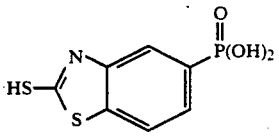
19
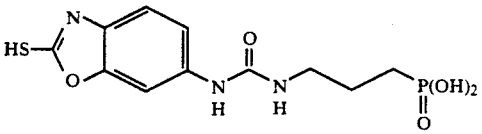
-continued
20
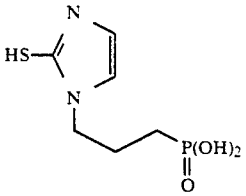
21
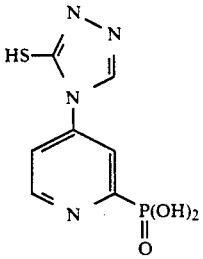
22
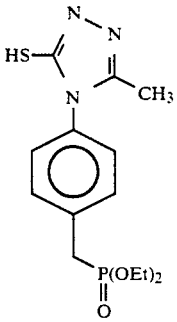
23
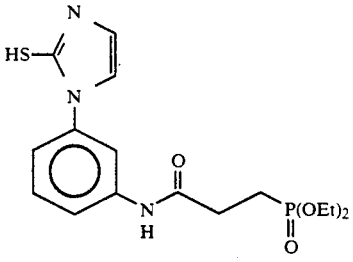
24
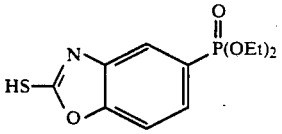
25
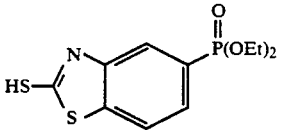
26
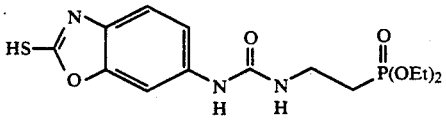
27
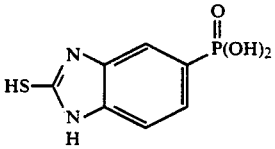

-continued

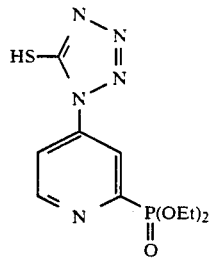

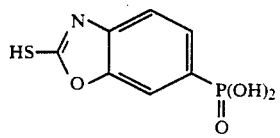

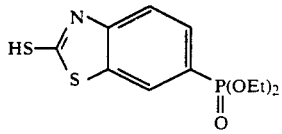

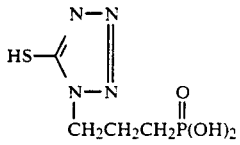

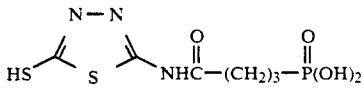

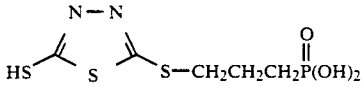

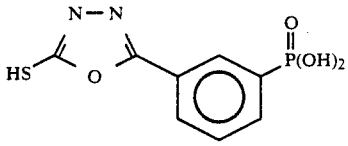

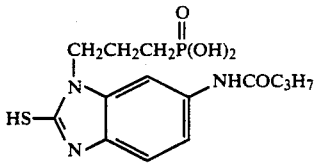

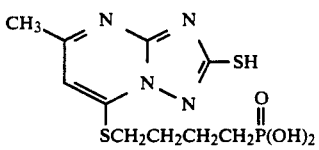

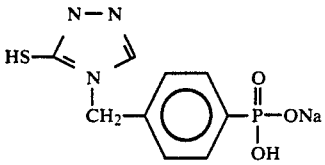

-continued

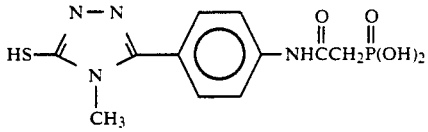

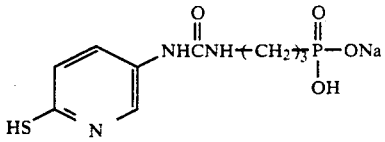

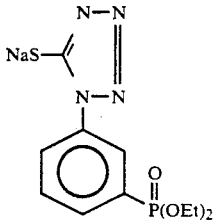

The synthesis of the compound represented by formula (I) to be used in the present invention will be described hereinafter.

The synthesis of the mercapto compounds represented by formula (I) to be used in the present invention can be normally accomplished by the following method. The synthesis of the mercapto-substituted heterocyclic ring will be discussed first. The synthesis of the phosphonic acid portion will follow.

i. The synthesis of the mercapto-substituted heterocyclic ring can be accomplished in accordance with any suitable method as described in Berichte der Deutschen Chemische Gesellschaft, 22, page 568 (1889), Berichte der Deutschen Chemische Gesellschaft, 29, page 2483 (1896), Journal of Chemical Society, (1932), page 1806, Journal of Chemical Society, 71, page 4000 (1949), U.S. Pat. Nos. 2,585,388 and 2,541,924, Advances in Heterocyclic Chemistry, 9, page 165 (1968), Organic Synthesis IV, page 569 (1963), Berichte der Deutschen Chemische Gesellschaft, 9, page 465 (1876), Journal of American Chemical Society, 45, page 2390 (1923), and Katritzky and Rees, "Comprehensive Heterocyclic Chemistry", vol. 2, vol. 3, vol. 4, vol. 5, and vol. 6. In particular, Katritzky and Rees, "Comprehensive Heterocyclic Chemistry" contains comprehensive and instructive description.

ii. The synthesis of the phosphonic acid portion will be divided into two sections, i.e., synthesis of alkylphosphonic acid and synthesis of arylphosphonic acid.

The synthesis of alkylphosphonic acid can be normally accomplished by a method which comprises the reaction of an alkyl halide with a sulfurous ester, i.e., the so-called Arbuzov Reaction, to produce an alkylphosphonic ester, and then subjecting the phosphonic ester to normal hydrolysis with an acid or alkali. For details, reference can be made to Synthesis, (1979), page 615, Synthesis, (1980), page 456, Chemical Review, (1981), vol. 81, page 415, and Journal of Organic Chemistry.

The synthesis of arylphosphonic acid can be relatively easily accomplished by any known method as described in Synthesis, (1979), page 21, and Journal of Organic Chemistry, vol. 24, page 3612 (1974). The former method comprises the reaction of a cyclic monochlorinated sulfurous ester with a diazonium salt to produce an arylphosphonic acid ester, and then subjecting the ester to hydrolysis. The latter method comprises the reaction of aryl iodide with dialkylsulfurous ester under the irradiation with light to produce an arylphosphonic acid ester, and then subjecting the ester to hydrolysis.

The connection of the mercapto-substituted heterocyclic ring portion to the phosphonic acid portion can be accomplished by many methods. For example, these portions can be connected to each other via an alkylene group or arylene group. This method can be used in combination with other methods such as connection via ester, connection via urethane bond, connection via urea bond, connection via ether bond, connection via carbonamido group and connection via sulfonamido group. Thus, these portions can be connected to each other via a combination of various divalent groups or groups having a higher valency.

The present invention will be further described with reference to specific examples of synthesis.

SYNTHESIS EXAMPLE 1

Synthesis of Exemplary Compound 5

1-1: Synthesis of triethylamine N-(3-acetylamiophenyl)dithiocarbaminate (1)

600 g of 3-aminoacetanilide was dissolved in 4 l of acetonirile. 800 ml of triethylamine was added to the material. 360 ml of carbon disulfide was then added dropwise to the mixture while the system was kept at a temperature of 20° C. or lower in an iced-water bath. After about 1.5 hours, the completion of the reaction was confirmed. The resulting crystals were filtered off to obtain 1,170 g of triethylamine N-(3-acetylaminophenyl)dithiocarbaminate (1) (yield: 90%). This product was not further purified before the following reaction.

1-2: Synthesis of 3-acetylaminophenylisothiocyanate (2)

270 g of triethylamine N-(3-aceylaminophenyl) dithiocarbaminate (1) was suspended in 800 ml of acetone. 100 ml of ethyl chlorocarbonate was added dropwise to the suspension in a stream of nitrogen while the system was kept at a temperature of 10° C. or lower in an iced-water bath. The gas evoluted was captured by an aqueous solution of sodium hypochlorite. After the completion of the dropwise addition, the resulting crystals were filtered off. 1 l of water was added to the filtrate. The resulting crystals were filtered off. These crystals were together washed with water, dried, and then recrystallized from acetonitrile to obtain 115 g of 3-acetylaminophenylisothiocyanate (2). (Yield: 76%; m.p. 148° C.)

1-3: Synthesis of 1-(3-acetylaminophenyl)-3-acetylthiosemicarbazide (3)

400 ml of ethanol was added to 30 g of 3-acetylaminophenylisothiocyanate (2) thus obtained. 13 g of acetohydrazide was then added to the mixture. The mixture was then stirred at room temperature. Crystal deposition began in about 30 minutes. After 4 hours, the resulting crystal was filtered off, and then dried to obtain 42 g of 1-(3-acetylaminophenyl)-3-acetylthiosemicarbazide (3). (Yield: 100%)

1-4: Synthesis of 4-(3-acetylaminophenyl)-3-methyl-5-mercaptotriazole (4)

70 g of 1-(3-acetylaminphenyl)-3-acetylthiosemicarbazide thus obtained were mixed with 250 ml of ethanol and 500 ml of 10% potassium hydroxide. The mixture was then heated under reflux over two hours. After being cooled, the system was adjusted with dilute hydrochloric acid to a pH value of 6 to 7 to deposit crystals. The crystals were then filtered off with suction, and dried to obtain 53 g of 4-(3-acetylaminophenyl)-3-methyl-5-mercaptotriazole (4). (Yield: 81%; m.p. 225° C.)

1-5: Synthesis of 4-(3-phenoxycarbonylaminophenyl)-3-methyl-5-mercaptotriazole (6)

150 ml of 12N hydrochloric acid was added to 10 g of 4-(3-acetylaminophenyl)-3-methyl-5-mercaptotriazole (4) thus obtained. The system was then heated under reflux. After 3 hours, the system was cooled. Water was then distilled off by a rotary evaporator to obtain crystals of crude 4-(3-aminophenyl)-3-methyl-5-mercaptotriazole (5). 100 ml of acetonitrile was added to this crystal. 12 g of pyridine was then added to the system. The system was stirred. 7.5 g of phenyl chlorocarbonate was added dropwise to the system while the system was kept at a temperature of 5° C. or lower in an iced-water bath. After completion of the dropwise addition, the system was allowed to undergo reaction over 10 minutes. 20 ml of water was added to the reaction solution. The solvent was then distilled off by a rotary evaporator. The resulting concentrated solution was extracted with ethyl acetate. The extract was then washed with saturated aqueous solution of sodium chloride, and dried with sodium sulfate anhydride. The solvent was distilled off to obtain a crystals of crude 4-(3-phenoxycarbonylaminophenyl)-3-methyl-5-mercaptotriazole (6). The crude crystals were recrystallized from ethyl acetate to obtain 13 g of Compound (6). (Yield: 98%; m.p. 188° C.)

1-6: Synthesis of N-(3-bromopropyl)phthalimide (7)

90 g of potassium phthalimide was mixed with 300 ml of dimethylacetamide and stirred. 74 ml of 1,3-dibromopropane was added to the system. The system was then allowed to undergo reaction at a temperature of 120° C. over 4 hours. The reaction solution was poured into 1 l of water. The resulting crystals were filtered off with suction. The crude crystals were recrystallized from ethanol to obtain 100 g of N-(3-bromopropyl)-phthalimide (7). (Yield: 77%; m.p. 65° C.)

1-7 Synthesis of diethyl 3-aminopropylphosphonate (8)

70 ml of triethyl phosphite was added to 40 g of N-(3-bromopropyl)phthalimide (7). The mixture was heated to a temperature of 140° C. The by-produced ethyl bromide was distilled off. The system was then heated over 4 hours. Excess triethyl phosphite was distilled off under reduced pressure by an aspirator. 9 ml of ethanol and hydrazine hydrate were added to the concentrated solution. The system was heated under reflux over 20 minutes. The resulting crystals were filtered off. A mixture of 10 g of oxalic acid and 50 ml of acetone were added to the filtrate. The resulting crystals were filtered off. The filtrate was concentrated. A small amount of water and acetone were added to the residue. The resulting crystals were filtered off. The filtrate was cooled to deposit crystals of oxalic acid salt of diethyl 3-aminopropylphosphonate (8). The crystals were filtered and dried under reduced pressure by a vacuum pump to obtain 12 g of diethyl 3-aminopropylphosphonate (8) in the form of oxalate. (Yield: 34%; m.p. 54° C.)

1-8: Synthesis of 4-[3-{3-(3-diethylphosphonopropyl) ureido}phenyl]-3-methyl-5-mercaptotriazole (9)

40 ml of acetonitrile was added to 5.0 g of 4-(3-phenoxycarbonylaminophenyl)-3-methyl-5-mercaptotriazole (6) prepared in Step 1-5. 8.2 g of triethylamine was added to the system. 4.1 g of oxalic acid salt of diethyl 3-aminopropylphosphonate (8) prepared in Step 1-7 was added to the system. The system was then allowed to undergo reaction at a temperature of 50° C. over 4 hours. After the completion of the reaction, the solvent was distilled off under reduced pressure. 100 ml of water was added to the residue to deposit 62 g of a crystal of 4-[3-{3-(3-diethylphosphonopropyl)ureido} phenyl]-3-methyl-5-mercaptotriazole (9). (Yield: 94%; m.p. 128° C.)

1-9: Synthesis of 4-[3-{3-(3-phosphonopropyl)ureido}phenyl]-3-methyl-5-mercaptotriazole (10) (synthesis of Exemplary Compound 5)

80 ml of 12N hydrochloric acid was added to 2.0 g of 4-[3-{3-(3-phosphonopropyl)ureido}phenyl]-3-methyl-5-mercaptotriazole (9) thus obtained. The system was allowed to undergo reaction at a temperature of 90° C. over 8 hours. After the completion of the reaction, hydrochloric acid was distilled off under reduced pressure. 20 ml of water was added to the system. The system was then dissolved under heating. Sodium chloride was gradually added to the solution to deposit crystals. The addition of sodium chloride continued until the solution was somewhat whitened. The solution thus whitened was then heated so that it was homogenized. The solution was naturally filtered, and then allowed to stand. As a result, a crystalline 4-[3-{3-(3-phosphonopropyl)ureido}phenyl]-3-methyl-5-mercaptotriazole (10) was deposited. (Yield: 0.58 g (33%); m.p. 195° C.)

The compound for use in the present invention is preferably incorporated in the light-sensitive material, particularly in the emulsion layer or other hydrophilic colloid layers during the preparation of the light-sensitive material.

The compound for use in the present invention can be incorporated in the light-sensitive material in the form of a solution in water or a proper organic solvent miscible with water (e.g., alcohol, ether, glycol, ketone, ester, amide).

The amount of the compound for use in the present invention to be used is preferably enough to attain an effect of inhibiting fog during the storage. In general, if the compound for used in the present invention is incorporated in the light-sensitive material, this value is preferably in the range of $10^{-7}$ to $10^{-2}$ mol, more preferably $10^{-6}$ to $10^{-1}$ mol per mol of silver.

The photographic emulsion layer in the light-sensitive material to be used in the present invention can comprise any silver halide selected from, e.g., silver bromide, silver bromoiodide, silver bromochloroiodide, silver bromochloride or silver chloride.

Silver halide grains in the photographic emulsions may be so-called regular grains having a regular crystal form, such as cube, octahedron and tetradecahedron, or those having an irregular crystal form such as sphere, those having a crystal defect such as twining plane, or those having a combination of these crystal forms.

The silver halide grains may be either fine grains of about 0.1 μm or smaller in diameter or giant grains having a projected area diameter of up to about 10 μm. The emulsion may be either a monodisperse emulsion having a narrow distribution or a polydisperse emulsion having a broad distribution.

The preparation of the photographic emulsion which can be used in the present invention can be accomplished by any suitable method as described in Glafkides, "Chimie et Physique Photographique", Paul Montel (1967), G. F. Duffin, "Photographic Emulsion Chemistry", Focal Press, (1966), and V. L. Zelikman et al., "Making and Coating Photographic Emulsion", Focal Press, (1964). In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, which is a type of the double jet process, in which a pAg value of a liquid phase in which silver halide grains are formed is maintained constant, may also be used. According to the controlled double jet process, a silver halide emulsion having a regular crystal form and an almost uniform grain size can be obtained.

Two or more kinds of silver halide emulsions which have been separately prepared can be used in admixture.

A silver halide emulsion comprising the above mentioned regular crystal grains can be obtained by controlling the pAg and pH values during the formation of grains. This method is further described in Photographic Science and Engineering, vol. 6, pp. 159 to 165, (1962), Journal of Photographic Science, vol. 12, pp. 242 to 251,(1964), U.S. Pat. No. 3,655,394, and British Patent 1,413,748.

Monodisperse emulsions are further described in JP-A-48-8600, JP-A-51-39027, JP-A-51-83097, JP-A-53-137133, JP-A-54-48521, JP-A-54-99419, JP-A-58-37635, and JP-A-58-49938 (the term "JP-A" as used herein means an "unexamined published Japanese patent application"), JP-B-47-11386 (the term "JP-B" as used herein means an "examined Japanese patent publication"), U.S. Pat. No. 3,655,394, and British Patent 1,413,748.

Tabular grains having an aspect ratio of about 5 or more can be used in the present invention. The preparation of such tabular grains can be easily accomplished by any suitable method as described in Cleve, "Photography Theory and Practice", (1930), page 131, Gutoff, "Photographic Science and Engineering", vol. 14, pp. 248 to 257, (1970), U.S. Pat. Nos. 4,434,226, 4,414,310, 4,433,048, and 4,439,520, and British Patent 2,112,157. The use of such tabular grains is advantageous in that it provides an increase in the covering power and an improvement in the efficiency of color sensitization with a sensitizing dye. This is further described in the above cited U.S. Pat. No. 4,434,226.

The individual silver halide crystals may have either a homogeneous structure or a heterogeneous structure composed of a core and an outer shell differing in halogen composition, or may have a layered structure. These emulsion grains are disclosed in British Patent 1,027,146, U.S. Pat. Nos. 3,505,068, and 4,444,877, and Japanese Patent Application No. 58-248469 (corresponding to JP-A-60-143331). Furthermore, the grains may have fused thereto a silver halide having a different halogen composition or a compound other than silver halide, e.g., silver thiocyanate, lead oxide, etc. by an epitaxial junction. These emulsion grains are disclosed in U.S. Pat. Nos. 4,094,685, 4,142,900, 4,459,353, 4,349,622, 4,395,478, 4,433,501, 4,463,087, 3,656,962, and 3,852,067, British Patent 2,038,792, and JP-A-59-162540.

Mixtures of grains having various crystal forms may also be used.

In order to accelerate ripening, a silver halide solvent can be effectively used. For example, it has been known that excess halogen ions are allowed to be present in a reaction vessel to accelerate ripening. Therefore, it is obvious that ripening can be accelerated only by incorporating a halide solution in a reaction vessel. Other ripening agents can be used. These ripening agents can be entirely incorporated in a dispersant in a reaction vessel before silver salts and halides are incorporated in the reaction vessel or may be incorporated in the reaction vessel together with one or more halides, silver salts or deflocculating agents. In another modified embodiment, a ripening agent can be independently incorporated at the step of incorporation of halide and silver salt.

As ripening agents other than halogen ion there can be used ammonia, amine compound, and thiocyanate such as thiocyanate of alkaline metal, particularly sodium and potassium thiocyanate, and ammonium thiocyanate. The use of thiocyanate ripening agents is taught in U.S. Pat. Nos. 2,222,264, 2,448,534, and 3,320,069. Further, commonly used thioether ripening agents described in U.S. Pat. Nos. 3,271,157, 3,574,628, and 3,737,313 can be used. Moreover, thione compounds as disclosed in JP-A-53-82408, and JP-A-53-144319 can be used.

The properties of silver halide grains can be controlled by allowing various compounds to be present in the system during the precipitation and formation of silver halide. These compounds can be initially present in the reaction vessel. Alternatively, these compounds can be incorporated together with one or more salts in accordance with the ordinary method. The properties of silver halide grains can be controlled by allowing a compound such as a compound of copper, iridium, lead, bismuth, cadmium, zinc, (chalcogen compound of sulfur, selenium, and tellurium), gold, and the noble metal of the group VII of the periodic table to be present in the system during the precipitation and formation of silver halide as described in U.S. Pat. Nos. 2,448,060, 2,628,167, 3,737,313, and 3,772,031, and *Research Disclosure* No. 13452, vol. 134, (June 1975). As described in JP-B-58-1410, and Moisar, "Journal of Photographic Science", vol. 25, (1977), pp. 19 to 27, silver halide emulsion grains can be internally reduction-sensitized during the precipitation and formation.

The silver halide emulsion to be used in the present invention is normally subjected to chemical ripening. The chemical sensitization can be effected with an active gelatin as described in T. H. James, "The Theory of the Photographic Process", 4th ed., Macmillan, (1977), pp. 67 to 76. Alternatively, the chemical sensitization can be effected with sulfur, selenium, tellurium, gold, platinum, palladium, iridium or a combination of a plurality of such sensitizers at a pAg value of 5 to 10 and a pH value of 5 to 8 and a temperature of 30° to 80° C. as described in *Research Disclosure* Nos. 12008, vol. 120, (April, 1974), and 13452, vol. 34, (June, 1975), U.S. Pat. Nos. 2,642,361, 3,297,446, 3,772,031, 3,857,711, 3,901,714, 4,266,018, and 3,904,415, and British Patent 1,315,755. An optimum chemical sensitization can be effected in the presence of a gold compound or a thiocyanate compound or in the presence of a sulfur-containing compound as described in U.S. Pat. Nos. 3,857,711, 4,266,018, and 4,054,457, or sulfur-containing compound such as hypo, thiourea compound and rhodanine compound. The chemical sensitization can be effected in the presence of a chemical sensitization aid. As such a chemical sensitization aid there can be used a compound which is known to serve to inhibit fog during chemical sensitization while increasing sensitivity, such as azaindene, azapyridazine and azapyrimidine. Examples of chemical sensitization aid improvers are described in U.S. Pat. Nos. 2,131,038, 3,411,914, and 3,554,757, JP-A-58-126526, and the above cited G. F. Duffin, "Photographic Emulsion Chemistry", pp. 138 to 143. In addition to or in place of chemical sensitization, reduction sensitization with, e.g., hydrogen, can be effected as described in U.S. Pat. Nos. 3,891,446, and 3,984,249, or with a reducing agent such as stannous chloride, thiourea dioxide and polyamine as described in U.S. Pat. Nos. 2,518,698, 2,743,182, and 2,743,183. Reduction sensitization can also be effected at a low pAg value (e.g., lower than 5) and/or a high pH value (e.g., higher than 8). The color sensitization can be improved by a chemical sensitization as described in U.S. Pat. Nos. 3,917,485, and 3,966,476.

The present light-sensitive material can comprise one or more surface active agents for the purpose of facilitating coating an emulsion dispersion, improving emulsification and dispersion property, smoothness and photographic properties (e.g., acceleration of development, increase in contrast, sensitization), or inhibiting static charge and adhesion.

The emulsion to be used in the present invention is normally subjected to spectral sensitization with a methine dye or other dyes. Examples of a spectral sensitizing dye to be used in the present invention include cyanine dye, melocyanine dye, complex cyanine dye, complex melocyanine dye, holopolar cyanine dye, hemicyanine dye, styryl dye and hemioxonol dye. Particularly useful among these dyes are cyanine dye, melocyanine dye, and complex melocyanine dye. Any of the nuclei which are commonly used as a basic heterocyclic nucleus for cyanine dye can be applied to these dyes. Examples of suitable nuclei which can be applied to these dyes include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nucleus obtained by fusion of alicyclic hydrocarbon rings to these nucleus or nucleus obtained by fusion of aromatic hydrocarbon rings to these groups, e.g., indolenine nucleus, benzindolenine nucleus, indole nucleus, benzoxazole nucleus, naphthoxazole nucleus, benzothiazole nucleus, naphthothiazole nucleus, benzosalenazole nucleus, benzimidazole nucleus and quinoline nucleus. These nuclei may contain substituents on the carbon atoms.

Examples of suitable nucleus which can be applied to melocyanine dye or complex melocyanine dye include those having a ketomethylene structure such as pyrazoline-5-one nucleus, thiohydantoin nucleus, 2-thioxazolidine-2,4-dione nucleus, thiazolidine-2,4-dione nucleus, rhodanine nucleus, thiobarbituric acid nucleus, and other 5- or 6-membered heterocyclic nucleus.

These sensitizing dyes can be used singly or in combination. A combination of sensitizing dyes is often used for the purpose of supersensitization. In combination with the sensitizing dye, a dye which does not exhibit a spectral sensitizing effect itself but exhibits a supersensitizing effect or a substance which does not substantially absorb visible light but exhibits a supersensitizing effect can be incorporated in the emulsion. Examples of such a dye or substance include aminostilbenzene compounds substituted by nitrogen-containing heterocyclic groups as described in U.S. Pat. Nos. 2,933,390 and 3,635,721, aromatic organic acid-formaldehyde condensates as described in U.S. Pat. No. 3,743,510, cadmium salts, and azaindene compounds. Combinations described in U.S. Pat. Nos. 3,615,613, 3,615,641, 3,617,295, and 3,635,721 are particularly useful.

In combination with the above described components represented by formula (I), the photographic emulsion to be used in the present invention can comprise various compounds for the purpose of inhibiting fogging during the preparation, storage or photographic processing of the light-sensitive material or stabilizing the photographic properties. In particular, there can be used many compounds known as antifogging agents or stabilizers. Examples of these antifogging agents or stabilizers include azoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole), mercaptopyrimidines, mercaptotriazines, thioketo compounds such as oxazolinethione, azaindenes such as triazaindenes, tetraazaindenes (particularly 4-hydroxy-substituted (1,3,3a,7)tetraazaindenes), and pentaazaindenes, benzenethiosulfonic acid, benzenesulfinic acid, and benzenesulfonic amide.

As a suitable binder or protective colloid to be incorporated in the emulsion layer or interlayer in the light-sensitive material of the present invention there may be advantageously used gelatin. Other hydrophilic colloids may be used. Examples of such hydrophilic colloids which can be used in the present invention include protein such as gelatin derivatives, graft polymer of gelatin with other high molecular compounds, albumine, and casein, saccharide dertivative such as cellulose derivative (e.g., hydroxyethyl cellulose, carboxymethyl cellulose and cellulose ester sulfate), sodium alginate, and starch derivative, homopolymer or copolymer such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other various synthetic hydrophilic high molecular compounds.

As gelatin there can be used commonly used lime-processed gelatin as well as acid-processed gelatin or enzyme-processed gelatin as described in Bulletin of Society of Scientific Photography of Japan, No. 16, page 30, (1966). Hydrolyzate of gelatin can also be used.

The light-sensitive material of the present invention can comprise an inorganic or organic hardening agent in any hydrophilic colloid layer constituting the photographic layer or backing layer. Specific examples of such a hardening agent include chromium salt, aldehyde (e.g., formaldehyde, glyoxal, glutaraldehyde), and N-methylol compound (e.g., dimethylurea). Active halogen compounds (e.g., 2,4-dichloro-6-hydoxy-1,3,5-triazine and sodium salt thereof) and active vinyl compounds (e.g., 1,3-bisvinylsulfonyl-2-propanol, 1,2-bis(-vinylsulfonylacetamido)ethane, vinyl polymer containing vinylsulfonyl group in side chain) are preferably used because they can rapidly cure a hydrophilic colloid such as gelatin to provide stable photographic properties. Other examples of hardening agents which can rapidly cure a hydrophilic colloid include N-carbamoylpyridinium salts e.g., (1-morpholinocarbonyl-3-pyridinio)methane sulfonate), and haloamidinium salts (e.g. 1-(1-chloro-1-pyridinomethylene)pyrrolidinium, 2-naphthalene sulfonate).

In the photographic light-sensitive material of the present invention, the photographic emulsion layer or other layers are coated on a flexible support commonly used in photographic light-sensitive materials, such as plastic film, paper and cloth or rigid material such as glass, ceramic and metal. Useful examples of flexible support materials include film made of semisynthetic or synthetic high molecular compound such as cellulose nitrate, cellulose acetate, cellulose acetate butyrate, polystyrene, polyvinyl chloride, polyethylene terephthalate, and polycarbonate, and paper coated or laminated with baryta layer or an α-olefin polymer (e.g., polyethylene, polypropylene, ethylene/butene copolymer) or the like. The support may be colored with a dye or pigment. The support may be blackened for the purpose of screening light. The support is normally undercoated to facilitate adhesion to the photographic emulsion layer. The surface of the support may be subjected to glow discharge, corona discharge, irradiation with ultraviolet light, flame treatment or the like before or after undercoating.

The present invention is applicable to various types of color and black-and-white light-sensitive materials. Typical examples of such color and black-and-white light-sensitive materials include color negative films for common use or motion picture, color reversal films for slide or television, color papers, color positive films, color reversal papers, color diffusion transfer type light-sensitive materials, and heat-developable color light-sensitive materials. With a mixture of three color couplers as described in *Research Disclosure* No.17123 (July, 1978) or a black color coupler as described in U.S. Pat. No. 4,126,461 and British Patent 2,102,136, the present invention is also applicable to black-and-white light-sensitive materials for X-ray. The present invention is further applicable to plate-making film such as lith film and scanner film, X-ray film for direct and indirect medical use or industrial use, negative black-and-white film for photographing, black-and-white photographic paper, microfilm for COM or commonly used microfilm, silver salt diffusion transfer type light-sensitive materials, and print out type light-sensitive materials.

If the present invention is applied to coupler type color light-sensitive materials, various color couplers can be used. The term "color coupler" as used herein means a "compound capable of undergoing coupling reaction with an oxidation product of an aromatic primary amine developing agent to produce a dye. Typical examples of useful color couplers include naphtholic or phenolic compound, pyrazolone or pyrazoloazole compound, and open-chain or heterocyclic ketomethylene compound. Specific examples of these cyan, magenta and yellow coupler which can be used in the present invention are described in patents cited in *Research Disclosure* Nos. 17643, VII-D, (December, 1978), and 18717, (November, 1979).

The color couplers to be incorporated in the light-sensitive material preferably contain ballast groups or are polymerized to exhibit nondiffusivity. Two-equivalent couplers in which the hydrogen atom in the coupling active position is substituted by a coupling-off group are better used than four-equivalent couplers in which a hydrogen atom is in the coupling active position because they can reduce the necessary coated amount of silver. Other examples of couplers which can be used in the present invention include couplers which form a dye having a proper diffusivity, colorless couplers, DIR couplers which release a development inhibitor upon coupling reaction and couplers which release a development accelerator upon coupling reaction.

A typical example of yellow coupler which can be used in the present invention is an oil protect type acylacetamide coupler. Typical examples of such an oil protect type acylacetamide coupler are described in U.S. Pat. Nos. 2,407,210, 2,875,057, and 3,265,506. In the present invention, two-equivalent yellow couplers are preferably used. Typical examples of such two-equivalent yellow couplers include oxygen atom-releasing type yellow couplers as described in U.S. Pat. Nos. 3,408,194, 3,447,928, 3,933,501, and 4,022,620, and nitrogen atom-releasing type yellow couplers as described in JP-B-58-10739, U.S. Pat. Nos. 4,401,752, and 4,326,024, *Research Disclosure* (RD) No. 18053 (April, 1979), British Patent 1,425,020, and West German Patent Application (OLS) Nos. 2,219,917, 2,261,361, 2,329,587, and 2,433,812. α-Pivaloylacetanilide couplers are excellent in the fastness of formed dye, especially to light. On the other hand, α-benzoylacetanilide couplers can provide a high color density.

Examples of magenta couplers which can be used in the present invention include oil protect type indazolone or cyanoacetyl, preferably 5-pyrazolone couplers and pyrazoloazole couplers such as pyrazolotriazoles. As 5-pyrazolone couplers there may be preferably used 5-pyrazolone couplers in which the hydrogen atom in the 3-position is substituted by an arylamino group or acylamino group in the light of the color hue or density of formed dye. Typical examples of such couplers are described in U.S. Pat. Nos. 2,311,082, 2,343,703, 2,600,788, 2,908,573, 3,062,653, 3,152,896, and 3,936,015. As a coupling-off group to be incorporated in such a two-equivalent 5-pyrazolone coupler there can be particularly preferably used a nitrogen atom-releasing group as described in U.S. Pat. No. 4,310,619 or an arylthio group as described in U.S. Pat. No. 4,351,897. 5-pyrazolone couplers containing a ballast group as described in European Patent 73,636 can provide a high color density.

Examples of pyrazoloazole couplers include pyrazolobenzimidazoles as described in U.S. Pat. No. 3,061,432. Preferred examples of pyrazoloazole couplers include pyrazolo[5,1-c][1,2,4]triazoles as described in U.S. Pat. No. 3,725,067, pyrazolotetrazoles as described in *Research Disclosure* No. 24220 (June, 1984) and JP-A-60-33552, and pyrazolopyrazoles as described in *Research Disclosure* No. 24230 (June, 1984) and JP-A-60-43659. Imidazo[1,2-b]pyrazoles as described in U.S. Pat. No. 4,500,630 can be preferably used because they can provide formed dyes having little secondary yellow absorption and an excellent fastness to light. In this respect, pyrazolo[1,5-b][1,2,4]triazole described in U.S. Pat. No. 4,540,654 is particularly preferred.

Examples of cyan couplers which can be used in the present invention include oil protect type naphthol and phenol couplers. Typical examples of such couplers include naphthol couplers as described in U.S. Pat. No. 2,474,293. Preferred examples of such couplers include oxygen atom-releasing type two-equivalent naphthol couplers as described in U.S. Pat. Nos. 4,052,212, 4,146,396, 4,228,233, and 4,296,200. Specific examples of phenolic couplers are described in U.S. Pat. Nos. 2,369,929, 2,801,171, 2,772,162, and 2,895,826. Cyan couplers which are fast to heat and moisture are preferably used in the present invention. Typical examples of such cyan couplers include phenolic cyan couplers containing an ethyl group or higher alkyl group in the meta-position of the phenole nucleus as described in U.S. Pat. No. 3,772,002, 2,5-diacylamino-substituted phenolic couplers as described in U.S. Pat. Nos. 2,772,162, 3,758,308, 4,126,396, 4,334,011, and 4,327,713, West German Patent Application (OLS) No. 3,329,729, and European Patent 121365, and phenolic couplers containing a phenylureido group in the 2-position and an acylamino group in the 5-position as described in U.S. Pat. Nos. 3,446,622, 4,333,999, 4,451,559, and 4,427,767. Cyan couplers in which the hydrogen atom in the 5-position of naphthol is substituted by a sulfonamido group, amido group or the like as described in Japanese Patent Application Nos. 59-93605, 59-264277 and 59-268135 (corresponding to JP-A-60-237448, JP-A-61-153640 and JP-A-61-145557, respectively) can form a dye excellent in fastness and can be preferably used in the present invention.

In order to eliminate unnecessary absorption by dyes produced from magenta and cyan couplers in a short wavelength range, color negative light-sensitive materials for photographing preferably comprise a colored coupler. Typical examples of such colored couplers include yellow-colored magenta couplers as described in U.S. Pat. No. 4,163,670, and JP-B-57-39413, and magenta-colored cyan couplers as described in U.S. Pat. Nos. 4,004,929, and 4,138,258, and British Patent 1,146,368.

The graininess of the light-sensitive material can be improved by the combined use of a coupler which forms a dye having a proper diffusivity. Specific examples of magenta couplers having such a function are described in U.S. Pat. No. 4,366,237, and British Patent 2,125,570. Specific examples of yellow, magenta and cyan couplers having such a function are described in European Patent 96570, and West German Patent Application (OLS) No. 3,234,533.

Dye-forming couplers and the above mentioned special couplers may form a dimer or higher polymer.

Typical examples of polymerized dye-forming couplers are described in U.S. Pat. Nos. 3,451,820, and 4,080,211. Specific examples of polymerized magenta couplers are described in British Patent 2,102,173, U.S. Pat. No. 4,367,282, Japanese Patent Application No. 60-75041 (corresponding to JP-A-61-232455), and Japanese Patent Application No. 61-113596.

In order to provide properties required for the light-sensitive material of the present invention, one or more of these various couplers can be incorporated in the same light-sensitive layer or the same coupler can be incorporated in two or more different light-sensitive layers.

The incorporation of these couplers in the light-sensitive material can be accomplished by any known dispersion method such as solid dispersion method and alkali dispersion method, preferably latex dispersion method, more preferably oil-in-water dispersion method. In the oil-in-water dispersion method, a coupler is dissolved in either or a mixture of a high boiling organic solvent having a boiling point of 175° C. or higher and an auxiliary solvent having a low boiling point and then the resulting solution is finely dispersed in an aqueous medium such as water and aqueous solution of gelatin in the presence of a surface active agent. Examples of such a high boiling organic solvent are described in U.S. Pat. No. 2,322,027. The dispersion may accompany phase inversion. If necessary, the auxiliary solvent can be removed by distillation, noodle rinsing, or ultrafiltration before coating.

Specific examples of high boiling organic solvents in which the color coupler is to be dispersed include phthalic esters (e.g., dibutyl phthalate, dicyclohexyl phthalate, di-2-ethylhexyl phthalate, decyl phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphonate, tridecyl phosphate, tributoxyethyl phosphate, trichloropropyl phosphate, di-2-ethylhexylphenyl phosphate), benzoic esters (e.g., 2-ethylhexyl benzoate, dodecyl benzoate, 2-ethylhexyl-p-hydroxybenzoate), amides (e.g., diethyldodecanamide, N-tetradecylpyrrolidone), alcohols or phenols (e.g., isostearylalcohol, 2,4-di-tert-amylphenol), aliphatic carboxylic esters (e.g., dioctylazelate, glycelol tributylate, isostearyl lactate, trioctyl citrate), aniline derivatives (e.g., N,N-dibutyl-2-butoxy-5-tert-octylaniline), and hydrocarbons (paraffin, dodecylbenzene, diisopropyl naphthalene). As an auxiliary solvent there can be used an organic solvent having a boiling point of about 30° C. or higher, preferably in the range of 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

Latex dispersion methods and their effect and specific examples of latexes for impregnation are described in U.S. Pat. No. 4,199,363, and West German Patent Application (OLS) 2,541,274, and 2,541,230.

Additives to be used in these steps are described in *Research Disclosure* (RD) Nos. 17643, pp. 23 to 28, and 18716, pp. 648 to 651, as tabulated below.

| Kind | RD17643 | RD18716 |
|---|---|---|
| 1. Chemical sensitizer | p. 23 | p. 648 right column (RC) |
| 2. Sensitivity increasing agent | | do. |
| 3. Spectral sensitizer and supersensitizer | pp. 23–24 | p. 648 RC-p. 649 RC |
| 4. Brightening agent | p. 24 | |
| 5. Antifoggant and stabilizer | pp. 24–25 | p. 649 RC |
| 6. Light absorbent, filter dye, and ultraviolet absorbent | pp. 25–26 | p. 649 RC-p. 650 left column (LC) |
| 7. Stain inhibitor | p. 25 RC | p. 650 LC-RC |
| 8. Dye image stabilizer | p. 25 | |
| 9. Hardening agent | p. 26 | p. 651 LC |
| 10. Binder | p. 26 | do. |
| 11. Plasticizer and lubricant | p. 27 | p. 650 RC |
| 12. Coating aid and surface active agent | pp. 26–27 | do. |
| 13. Antistatic agent | p. 27 | do. |

The photographic processing of the light-sensitive material of the present invention can be accomplished with any known processing solution by any method. The processing temperature is normally selected from the range between 18° C. and 50° C. but may be lower than 18° C. or higher than 50° C. Either development for the formation of silver images (black-and-white photographic processing) or color photographic processing comprising development for the formation of dye images can be applied depending on the purpose.

The black-and-white developer can comprise known developing agents such as dihydroxybenzene (e.g., hydroquinone), 3-pyrazolidone (e.g., 1-phenyl-3-pyrazolidone) and aminophenol (e.g., N-methyl-p-aminophenol) singly or in combination.

The color developer normally consists of an alkaline aqueous solution containing a color developing agent. As such a color developing agent there can be used a known primary aromatic amine developing agent such as phenylenediamine (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline).

Other examples of color developing agents which can be used in the present invention include those described in L. F. A. Mason, "Photographic Processing Chemistry"Focal Press (1966), pp. 226 to 229, U.S. Pat. Nos. 2,93,015, and 2,592,364, and JP-A-48-64933.

The developer can further comprise a pH buffer such as sulfite, carbonate, borate and phosphate of alkaline metal, or development inhibitor or antifogging agent such as bromide, iodide and organic antifogging agent other than the compound of the present invention. If necessary, the developer can comprise a water softener, a preservative such as hydroxylamine, an organic solvent such as benzyl alcohol and diethylene glycol, a development accelerator such as polyethylene glycel, quaternary ammonium salt and amine, a dye-forming coupler, competing coupler, a fogging agent such as sodium boron hydride, an auxiliary developing agent such as 1-phenyl-3-pyrazolidone, a thickening agent, a polycarboxylic chelating agent as described in U.S. Pat. No. 4,083,723, an oxidation inhibitor as described in West German Patent Application (OLS) 2,622,950 or the like.

If color photographic processing is effected, the light-sensitive material which has been color-developed is normally subjected to bleach. Bleach can be effected at the same time with or separately of fixing. Examples of bleaching agent which can be used in the present invention include compounds of polyvalent metal such as iron (III), cobalt (III), chromium (VI) and copper (II), peroxides, quinones, and nitroso compounds. Specific examples of these compounds include ferricyanides, dichromates, organic complex salts of iron (III) or cobalt (III) with, e.g., aminopolycarboxylic acid such as ethylenediaminetetraacetic acid, nitrilotriacetic acid and 1,3-diamino-2-propanoltetraacetic acid and organic acid such as citric acid, tartaric acid and malic acid, persulfates, permanganates, and nitrosophenol.

Particularly preferred among these bleaching agents are potassium ferricyanide, sodium ethylenediaminetetraacetato ferrate, and ammonium ethylenediaminetetraacetato ferrate. ethylenediaminetetraacetato ferrate complex salt is useful in a bleaching solution as well as in a combined bleaching and fixing bath.

The bleaching or blix solution can comprise various additives besides bleach accelerators as described in U.S. Pat. Nos. 3,042,520, and 3,241,966, and JP-B-45-8506, and JP-B-45-8836, and thiol compounds as described in JP-A-53-65732.

The rinsing step can be effected in a single tank process in some cases but is normally effected in a multistage countercurrent process comprising two or more tanks. The amount of water to be used in the rinsing step can be arbitrarily predetermined depending on the kind and purpose of color light-sensitive material. This value can be calculated by, e.g., a method as described in S. R. Goldwasser, "Water Flow Rates in Immersion-Washing of Motion Picture Film", Journal of Motion Picture and Television Engineering, vol. 64, pp. 248 to 253 (May, 1955).

If the amount of rinsing water is reduced, the proliferation of bacteria or mold may arise. In order to cope with this problem, rinsing water having a reduced concentration of calcium and magnesium as described in Japanese Patent Application No. 61-131632 (corresponding to JP-A-62-288838) can be used. Further, a germicide or anti-mold such as compounds as described in Journal of Antibacterial and Antifungal Agents, vol. 11, No. 5, pp. 207 to 223 (1983), and Hiroshi Horiguchi, "Bokin Bobi no Kagaku" can be used. Examples of water softners which can be incorporated in rinsing water include chelating agents such as ethylenediaminetetraacetic acid, and diethylenetriaminepentaacetic acid.

If the amount of rinsing water is reduced, it is normally in the range of 100 ml to 2000 ml per $m^2$ of color light-sensitive material. In particular, this value is preferably in the range of 200 ml to 1000 ml to accomplish dye stability as well as water saving effect.

The pH value of the rinsing water is normally in the range of 5 to 9.

If the light-sensitive material of the present invention is applied to color diffusion transfer photography, it can be in the form of film unit of peel apart type, integrated type as described in JP-B-46-16356 and JP-B-48-33697, and JP-A-50-13040 or peelless type as described in JP-A-57-119345.

In any of these types of formats, a polymeric acid layer protected by a neutralization timing layer can be advantageously used to widen the tolerance of the processing temperature. If the light-sensitive material of the present invention is applied to color diffusion transfer photography, such a polymeric acid layer can be incorporated in any layer in the light-sensitive material. Alternatively, such a polymeric acid can be contained as developer component in a processing solution container.

In order to obtain a broad range of colors in chromaticity diagram from three primaries, i.e., yellow, magenta and cyan, at least three silver halide emulsion layers having light sensitivity in different spectral range are used in combination. Examples of such a combination include a combination of blue-sensitive layer, green-sensitive layer and red-sensitive layer, and a combination of green-sensitive layer, red-sensitive layer and infrared-sensitive layer. These light-sensitive layers can be arranged in various orders as known in the field of color light-sensitive material. These light-sensitive layers each may be divided into two or more layers as necessary.

If the light-sensitive material of the present invention is used as a heat-developable light-sensitive material, organic metallic salts can be used as oxidizing agent in combination with a light-sensitive silver halide. Particularly preferred among these organic metallic salts are organic silver salts.

Examples of organic compound which can be used for the formation of the above mentioned organic silver salt oxidizing agent include benzotriazoles as described in U.S. Pat. No. 4,500,626 (columns 52 to 53), aliphatic acids, and other compounds. Other useful examples of organic compounds include silver salts with carboxylic acid containing alkynyl group such as phenylpropiolic acid as described in JP-A-60-113235, and acetylene silver as described in JP-A-61-249044. Two or more such organic silver salts can be used in combination.

Such an organic silver salt can be used in an amount of 0.01 to 10 mol, preferably 0.01 to 1 mol per mol of light-sensitive silver halide. The sum of the coated amount of light-sensitive silver halide and organic silver salt is preferably in the range of 50 mg of 10 g/$m^2$ as calculated in terms of silver.

As reducing agents to be incorporated in heat-developable light-sensitive material there can be used those known in the field of heat-developable light-sensitive materials. Examples of such reducing agents include reducing dye-providing compounds as described later (in this case, other reducing agents can be used in combination therewith). Other examples of such reducing agents which can be used include a reducing agent precursor which doesn't have a reducing power itself but exhibits a reducing power when acted on by a nucleophilic agent or heat during development.

Examples of reducing agents to be incorporated in heat-developable light-sensitive materials or used in color diffusion transfer photography include reducing agents and reducing agent precursors as described in U.S. Pat. No. 4,500,626 (Columns 49 to 50), U.S. Pat. No. 4,483,914 (Columns 30 to 31), U.S. Pat. Nos. 4,330,617, and 4,590,152, JP-A-60-140335 (pp. 17 to 18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-A-60-198540, JP-A-60-181742, JP-A-61-259253, JP-A-62-244044, JP-A-62-131253, JP-A-62-131254, JP-A-62-131255, and JP-A-62-131256, and European Patent 220746A2 (pp. 78 to 96).

Various combinations of reducing agents described in U.S. Pat. No. 3,039,869 can be used.

If a nondiffusion reducing agent is used, an electron transfer agent and/or electron transfer agent precursor can be used in combination therewith to accelerate the migration of electrons between the nondiffusion reducing agent and the developable silver halide as necessary.

Such an electron transfer agent or its precursor can be selected from the reducing agents as described above or their precursors. These electron transfer agents or their precursors are preferably greater than nondiffusion reducing agents (electron donor) in mobility. Particularly useful among these electron transfer agents are 1-phenyl-3-pyrazolidone and aminophenol.

As nondiffusion reducing agents (electron donor) to be used in combination with electron transfer agents there can be used any reducing agents as described above which do not substantially migrate in the light-sensitive material layer. Preferred examples of such nondiffusion reducing agents include hydroquinones, sulfonamidophenols, sulfonamidonaphthols, compounds described as electron donor in JP-A-53-110827, and nondiffusion reducing dye-providing compounds as described later.

In the present invention, the amount of the reducing agent to be incorporated is in the range of 0.001 to 20 mol, particularly 0.01 to 10 mol per mol of silver.

In heat-developable color diffusion transfer process or ordinary color diffusion transfer process, a compound which produces or releases a mobile dye in correspondence to or in counter correspondence to the reduction of silver ion to silver is used.

Examples of such a dye-providing compound include a compound (coupler) which undergoes oxidation coupling reaction to form a dye. Such a coupler may be either a two-equivalent or a four-equivalent coupler. Other preferred examples of such a dye-providing compound include a two-equivalent coupler containing a nondiffusion group as coupling-off group which undergoes oxidation coupling reaction to form a diffusible dye. This nondiffusion group can form a polymer chain. Specific examples of color developers and couplers are described in T. H. James, "The Theory of the Photographic Process", pp. 291 to 334, and pp. 354 to 361, and JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Other examples of dye-providing compound include a compound which serves to imagewise release or diffuse a diffusible dye. This type of a compound can be represented by formula (LI):

$$(\text{Dye}—\text{Y})_n—\text{Z} \qquad \text{(LI)}$$

wherein Dye represents a dye group, dye group which has been temporarily shifted to a short wavelength range in its absorption or dye precursor group; Y represents a mere bond or connecting group; Z represents a group which makes difference in the diffusivity of the compound represented by $(\text{Dye}—\text{Y})_n—\text{Z}$ in correspondence to or counter correspondence to light-sensitive silver salt having a imagewise latent image or releases Dye to make difference in diffusivity between Dye thus released and $(\text{Dye}—\text{Y})_n—\text{Z}$ in correspondence to or counter correspondence to light-sensitive silver salt having a imagewise latent image; and n represents an integer 1 or 2. When n is 2, the two (Dye—Y)'s may be the same or different.

Specific examples of the dye-providing compound represented by formula (LI) include the following compounds i) to v). The compounds i) to iii) form a diffusive dye image (positive dye image) in counter correspondence to the development of silver halide. The compound iv) and v) form a diffusive dye image (negative dye image) in correspondence to the development of silver halide.

i) Dye developing agents in which a hydroquinone developing agent and a dye component are connected to each other as described in U.S. Pat. Nos. 3,134,764, 3,362,819, 3,597,200, 3,544,545, and 3,482,972. These dye developing agents stay diffusive in an alkaline atmosphere but becomes nondiffusive upon reaction with silver halide.

ii) Nondiffusion compounds which release a diffusive dye in an alkaline atmosphere but lose their capability upon reaction with silver halide can be used as described in U.S. Pat. No. 4,503,137. Examples of such nondiffusion compounds include compounds which undergo intramolecular nucleophilic substitution reaction to release a diffusive dye as described in U.S. Pat. No. 3,980,479, and compounds which undergo intramolecular rearrangement reaction of isooxazolone ring to release a diffusive dye as described in U.S. Pat. No. 4,199,354.

iii) Nondiffusion compounds which undergo reaction with a reducing agent left unoxidized after development to release a diffusive dye can be used as described in U.S. Pat. Nos. 4,559,290 and 4,783,396, European Patent 220746A2, and Kokai Giho 87-6199.

Examples of such nondiffusion compounds include compounds which undergo intramolecular nucleophilic substitution reaction after reduction to release a diffusive dye as described in U.S. Pat. Nos. 4,139,389, and 4,139,379, and JP-A-59-185333, and JP-A-57-84453, compounds which undergo intramolecular electron migration reaction after reduction to release a diffusive dye as described in U.S. Pat. No. 4,232,107, JP-A-59-101649, and JP-A-61-88257, and RD24025 (1984), compounds which undergo cleavage of single bond after reduction to release a diffusive dye as described in West German Patent 3,008,588A, JP-A-56-142530, and U.S. Pat. Nos. 4,343,893, and 4,619,884, nitro compounds which release a diffusive dye after receiving electron as described in U.S. Pat. No. 4,450,223, and compounds which release a diffusive dye after receiving electron as described in U.S. Pat. No. 4,609,610.

Preferred examples of such nondiffusion compounds include compounds containing an N—X bond (in which X represents an oxygen, sulfur or nitrogen atom) and an electrophilic group per molecule as described in European Patent 220746A2, Kokai Giho 87-6199, U.S. Pat. No. 4,783,396 and JP-A-63-201653, and JP-A-63-201654, compounds containing an $SO_2$—X (in which X is as defined above) and an electrophilic group per molecule as described in Japanese Patent Application No. 62-106885 (corresponding to JP-A-1-26842), compounds containing a PO—X bond (in which X is defined above) and an electrophilic group per molecule as described in JP-A-63-271344, and compounds containing a C—X' bond (in which X' has the same meaning as X or represents —$SO_2$—) and an electrophilic group per molecule as described in JP-A-63-271341. Other examples of nondiffusion compounds which can be used include compounds which undergo cleavage of single bond by $\pi$ bond conjugated with electron-accepting group after reduction to release a diffusive dye as described in Japanese Patent Application Nos. 62-319989 and 62-320771 (corresponding to JP-A-1-161237 and JP-A-1-161342, respectively).

Particularly preferred among these nondiffusion compounds are those containing an N—X bond and an electrophilic group per molecule. Specific examples of such compounds include Compounds (1) to (3), (7) to (10), (12), (13), (15), (23) to (26), (31), (32), (35), (36), (40), (41), (44), (53) to (59), (64), and (70) described in European Patent 220746A2 and U.S. Pat. No. 4,783,396, and Compounds (11) to (23) described in Kokai Giho 87-6199.

iv) Compounds containing a diffusive dye as coupling-off group which undergo reaction with an oxidation product of a reducing agent to release a diffusive dye (DDR coupler). Specific examples of such DDR couplers are described in British Patent 1,330,524, JP-B-48-39165, and U.S. Pat. Nos. 3,443,940, 4,474,867, and 4,483,914.

v) Compounds which can reduce silver halide or an organic silver salt to release a diffusive dye (DRR compound). If such a compound is used, other reducing agents may not be used, causing no image stain with an oxidation decomposition product of a reducing agent. Typical examples of such DRR compounds are described in U.S. Pat. Nos. 3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51-104343, JP-A-58-116537, and JP-A-57-179840, and *Research Disclosure* (RD) 17465 (Oct., 1978). Specific examples of such DRR compounds include those described in U.S. Pat. No. 4,500,626 (Columns 22 to 44). Particularly preferred among these compounds are Compounds (1) to (3), (10) to (13), (16) to (19), (28) to (30), (33) to (35), (38) to (40), and (42) to (64) described in the above cited U.S. patents. Other useful examples of such DRR compounds include those described in U.S. Pat. No. 4,639,408 (Columns 37 to 39).

Examples of dye-providing compounds other than the above mentioned couplers and the compound represented by formula (LI) include dye silver compounds obtained by connection of organic silver salts to dyes as described in *Research Disclosure,* (May 1978), pp. 54 to 58, azo dyes for use in a heat-developable silver dye bleach process as described in U.S. Pat. No. 4,235,957, and *Research Disclosure,* (April 1976), pp. 30 to 32, and leuco dyes as described in U.S. Pat. Nos. 3,985,565, and 4,022,617.

A particularly preferred embodiment of the present invention is a heat-developable light-sensitive material comprising on a support at least a light-sensitive silver halide, a binder, an electron transfer agent or precursor thereof, an electron donor or precursor thereof, and a reducible dye-providing compound which undergoes reduction to release a diffusive dye, characterized in that there are contained one or more layers containing at least one compound represented by formula (I).

The reducible dye-providing compound to be used in the present invention will be further described hereinafter.

The reducible dye-providing compound to be used in the present invention is preferably a compound represented by formula (C-I):

$$\text{PWR—(Time)}_t\text{—Dye} \qquad \text{(C-I)}$$

wherein PWR represents a group which releases —(time)$_t$—Dye by being reduced; Time represents a group which releases Dye through following reactions after being released as —(Time)$_t$—Dye; t represents an integer of 0 or 1; and Dye represents a dye or precursor thereof.

Firstly, PWR will be further described hereinafter.

PWR may correspond to a portion containing an electron-accepting center and an intramolecular nucleophilic substitution reaction center in a compound which undergoes intramolecular nucleophilic substitution reaction after reduction to release a photographic reagent as disclosed in U.S. Pat. Nos. 4,139,389, 4,139,379, and 4,564,577, and JP-A-59-185333, and JP-A-57-84453 or a portion containing an electron-accepting quinonoid center and a carbon connecting a photographic reagent thereto in a compound which undergoes intramolecular electron migration reaction after reduction to allow the photographic reagent to be separated as disclosed in U.S. Pat. No. 4,232,107, JP-A-59-101649, and JP-A-61-88257, and *Research Disclosure* No. 24025 (April, 1984), IV. PWR may also correspond to a portion containing an aryl group substituted by an electrophilic group and an atom (e.g., sulfur, carbon, nitrogen) connecting a photographic reagent thereto in a compound which undergoes cleavage of single bond after reduction to release the photographic reagent as disclosed in JP-A-56-142530, and U.S. Pat. Nos. 4,343,893, and 4,619,884. Alternatively, PWR may correspond to a portion containing a nitro group and a carbon atom connecting a photographic reagent thereto in a nitro compound which releases the photographic reagent after receiving an electron as disclosed in U.S. Pat. No. 4,450,223. Further, PWR may correspond to a portion containing a geminal dinitro group and a carbon atom connecting a photographic reagent thereto in a dinitro compound which undergoes $\beta$-elimination of the photographic reagent after receiving electron as described in U.S. Pat. No. 4,609,610.

Preferred examples of PWR include compounds containing an N—X bond (in which X represents an oxygen atom, sulfur atom or nitrogen atom) and an electrophilic group per molecule as described in European Patent 220746A2, Kokai Giho 87-6199, U.S. Pat. No. 4,783,396, and JP-A-63-201653, and JP-A-63-201654, compounds containing an $SO_2$—X (in which X is as defined above) and an electrophilic group per molecule as described in Japanese Patent Application No. 62-106885 (corresponding to JP-A-1-26842), compounds containing a PO—X bond (in which X is as defined above) and an electrophilic group per molecule as described in JP-A-63-271344, and compounds containing a C—X′ bond (in which X′ has the same meaning as X or represents —$SO_2$—) and an electrophilic group per molecule as described in JP-A-63-271341. Other examples of PWR which can be used include compounds which undergo cleavage of single bond by $\pi$ bond conjugated with an electron-accepting group after reduction to release a diffusive dye as described in Japanese Patent Application Nos. 62-319989 and 62-320771 corresponding to JP-A-1-161237 and JP-A-1-161342, respectively).

In order to accomplish the objects of the present invention more thoroughly, a compound represented by formula (CII) among those represented by formula (C-I) is preferably used.

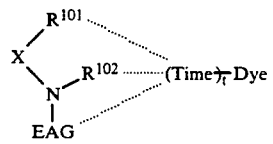

(CII)

wherein (Time)$_t$ Dye is connected to at least one of $R^{101}$, $R^{102}$ and EAG.

The portion in formula (CII) corresponding to PWR will be further described hereinafter.

X represents an oxygen atom (—O—), sulfur atom (—S—) or group containing a nitrogen atom (—N($R^{103}$)—).

$R^{101}$, $R^{102}$ and $R^{103}$ each represents a group other than hydrogen atom or a mere bond.

Examples of the group other than hydrogen atom represented by $R^{101}$, $R^{102}$ and $R^{103}$ include alkyl group, aralkyl group, alkenyl group, alkynyl group, aryl group, heterocyclic group, sulfonyl group, carbamoyl group, and sulfamoyl group. These groups may contain substituents.

$R^{101}$ and $R^{103}$ each is preferably a substituted or unsubstituted alkyl group, alkenyl group, alkynyl group, aryl group, heterocyclic group, acyl group or sulfonyl group. $R^{101}$ and $R^{103}$ each preferably contains 1 to 40 carbon atoms.

$R^{102}$ is preferably a substituted or unsubstituted acyl group or sulfonyl group. Examples of such acryl and sulfonyl group include those described with reference to $R^{101}$ and $R^{103}$. $R^{102}$ preferably contains 1 to 40 carbon atoms.

$R^{101}$, $R^{102}$ and $R^{103}$ may be connected to each other to form a 5- to 8-membered ring.

X is particularly preferably an oxygen atom.

EAG will be described later.

In order to accomplish the objects of the present invention further thoroughly, a compound represented by formula (CIII) among those represented by formula (CII) is preferably used.

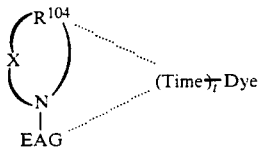

(CIII)

wherein $(Time)_t$ Dye is connected to at least one of $R^{104}$ and EAG.

X is as defined above.

$R^{104}$ represents an atomic group which is connected to X and a nitrogen atom to form a monocyclic or condensed heterocyclic group containing 5 to 8 members including a nitrogen atom.

EAG represents a group which receives electron from a reducing substance and is connected to a nitrogen atom. EAG is preferably a group represented by formula (A):

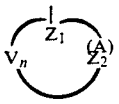

wherein $Z_1$ represents

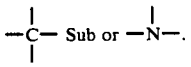

$V_n$ represents an atomic group which forms a 3- to 8-membered aromatic group together with $Z_1$ and $Z_2$. The suffix n represents an integer 3 to 8.

$V_3$; $—Z_3—$, $V_4$; $—Z_3—Z_4—$, $V_5$; $—Z_3—Z_4—Z_5—$, $V_6$; $—Z_3—Z_4—Z_5—Z_6—$, $V_7$; $—Z_3—Z_4—Z_5—Z_6—Z_7—$, $V_8$; $—Z_3—Z_4—Z_5—Z_6—Z_7—Z_8—$ $Z_2$ to $Z_8$ each represents

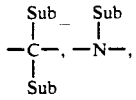

—O—, —S—, or $—SO_2—$. Sub represents a mere bond (β bond), hydrogen atom or substituent as described later. Sub's may be the same or different and may be connected to each other to form a 3- to 8-membered saturated or unsaturated carbon ring or heterocyclic group.

In formula (A), Sub is selected such that the total of the Hammett's substituent constant a para of substituents is in the range of +0.50 or more, more preferably +0.70 or more, particularly +0.85 or more.

EAG preferably is an aryl group or heterocyclic group substituted by at least one electrophilic group. The substituent to be connected to the aryl or heterocyclic group represented by EAG can be used to control the physical properties of the entire compound. Examples of physical properties which can be controlled include easiness for reception of electron, water solubility, oil solubility, diffusibility, sublimability, melting point, dispersibility in a binder such as gelatin, reactivity with a nucleophilic group, and reactivity with an electrophilic group.

Specific examples of EAG are described in EP-A-220746, pp. 6 to 7.

Time represents a group which releases Dye via subsequent reaction triggered by cleavage of nitrogen-oxygen bond, nitrogen-nitrogen bond or nitrogen-sulfur bond.

There are known various groups represented by Time. Examples of these groups include those described in JP-A-61-147244, pp. 5 to 6, and JP-A-61-236549, pp. 8 to 14, and Japanese Patent Application No. 61-88625 (corresponding to JP-A-62-215270), pp. 36 to 44.

Examples of dyes represented by Dye include azo dye, azomethine dye, anthraquinone dye, naphthoquinone dye, styryl dye, nitro dye, quinoline dye, carbonyl dye, and phthalocyanine dye. These dyes can be used in a form which has been temporarily shifted to a short wavelength range in absorption and can recover its original color upon development.

In particular, Dye's disclosed in EP-A-76492, and JP-A-59-165054 can be used.

The compounds represented by formula (CII) or (CIII) need to be immobile in the photographic layer themselves. To this end, these compounds preferably contain a ballast group containing 8 or more carbon atoms in the position of EAG, $R^{101}$, $R^{102}$, $R^{104}$ or X (particularly EAG).

Specific examples of typical reducible dye-providing compounds to be used in the present invention will be set forth below, but the present invention should not be construed as being limited thereto. Other examples of reducible dye-providing compounds which can be used in the present invention include those described in EP-A-220746, and Kokai Giho 87-6199.

(1)
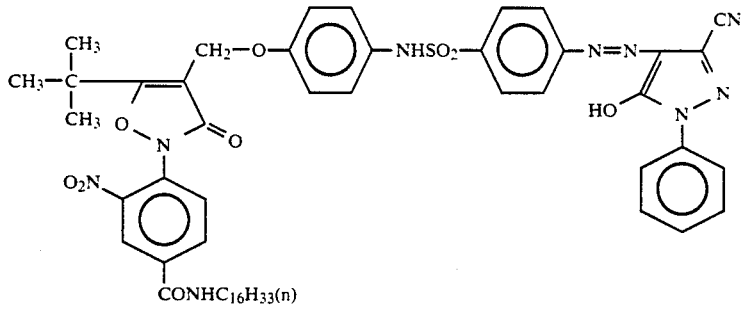
(2)
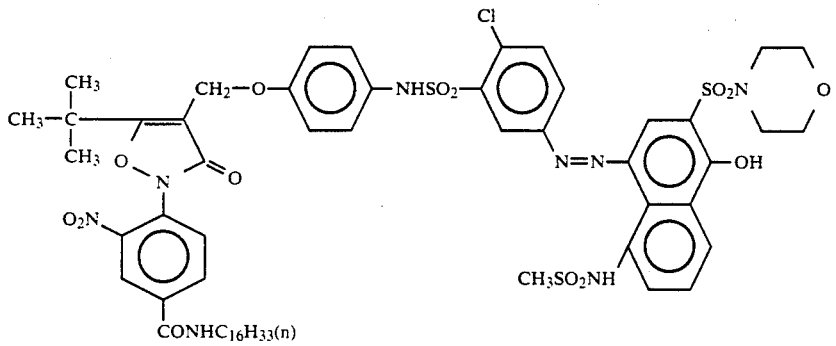
(3)
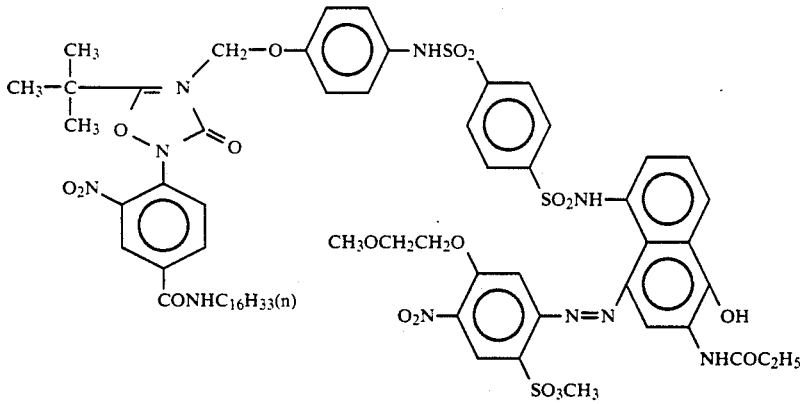
(4)
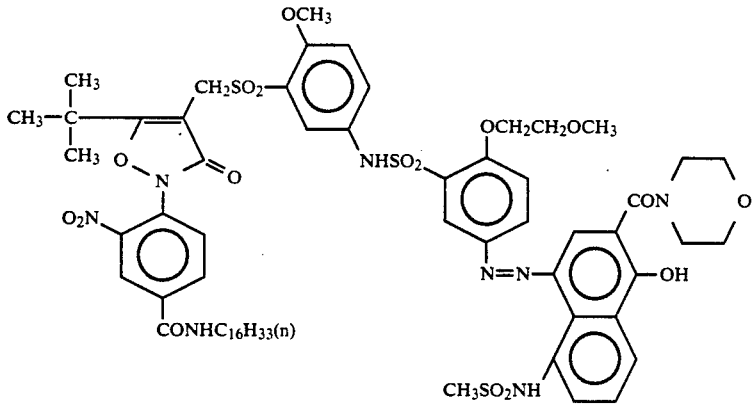

-continued
(5)
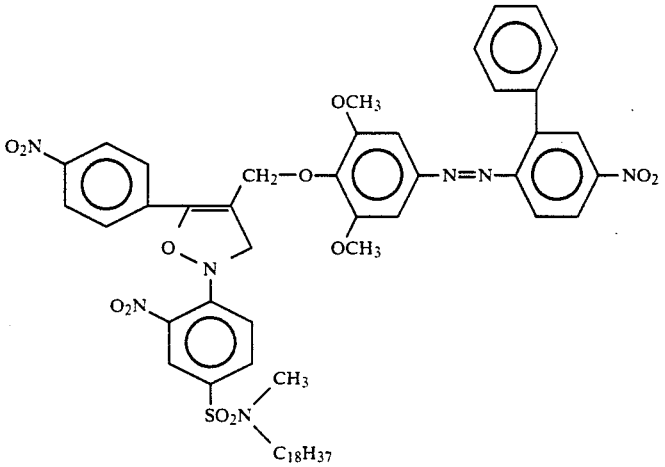
(6)
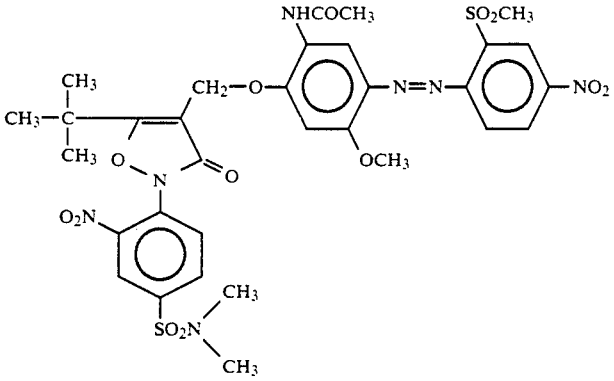
(7)
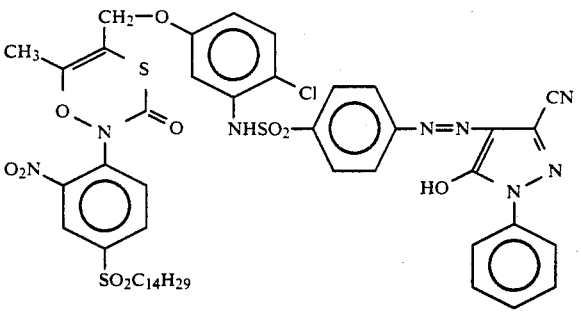
(8)
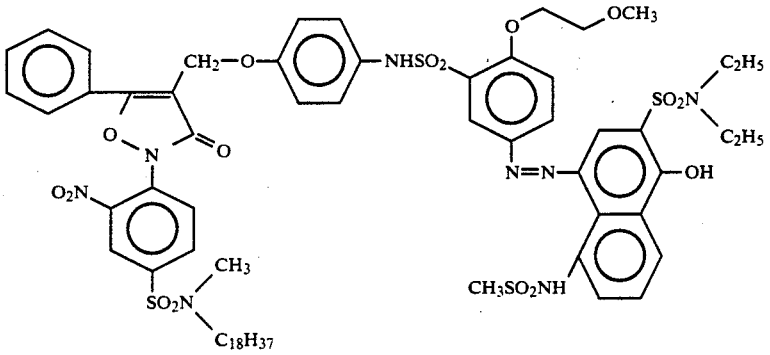

-continued
(9)
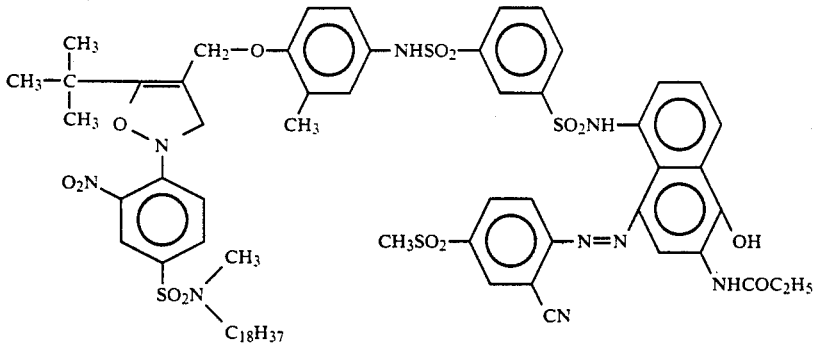
(10)
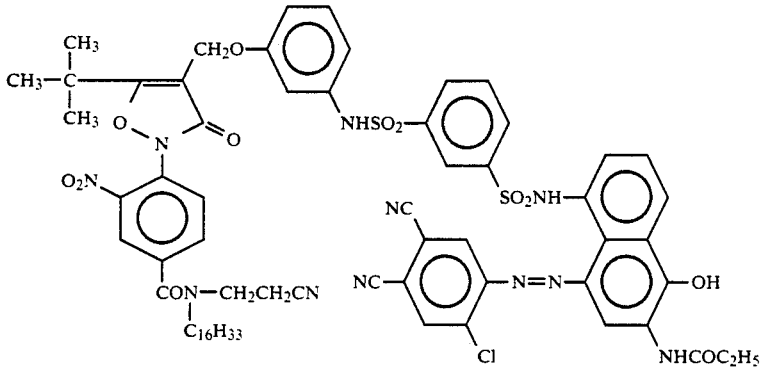
(11)
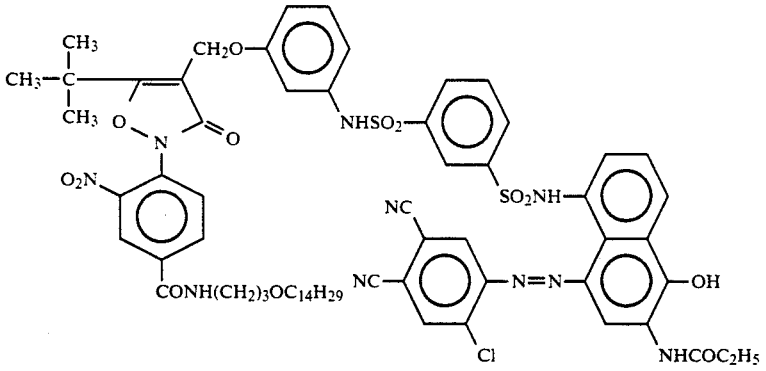
(12)
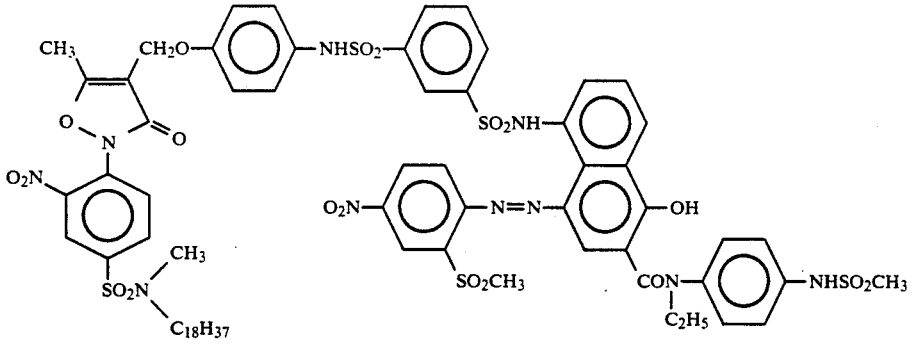
(13)
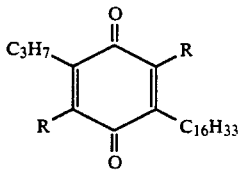
R:

-continued
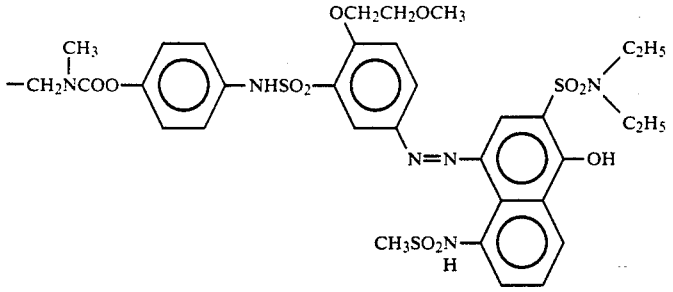
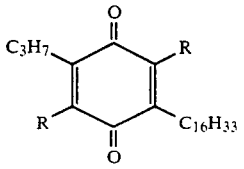
(14)
R:
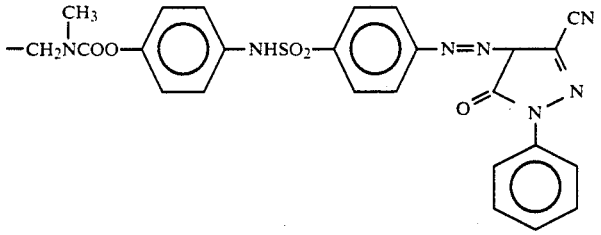
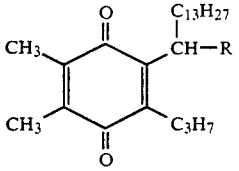
(15)
R:
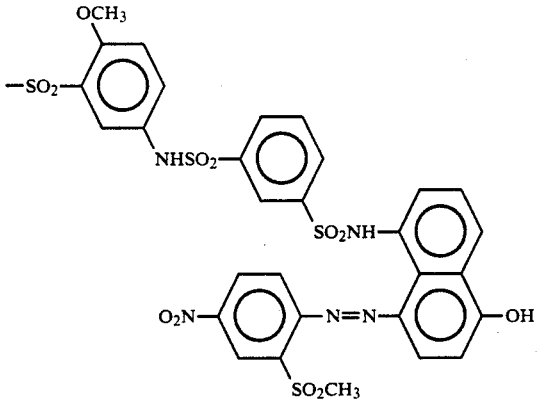

-continued (16)

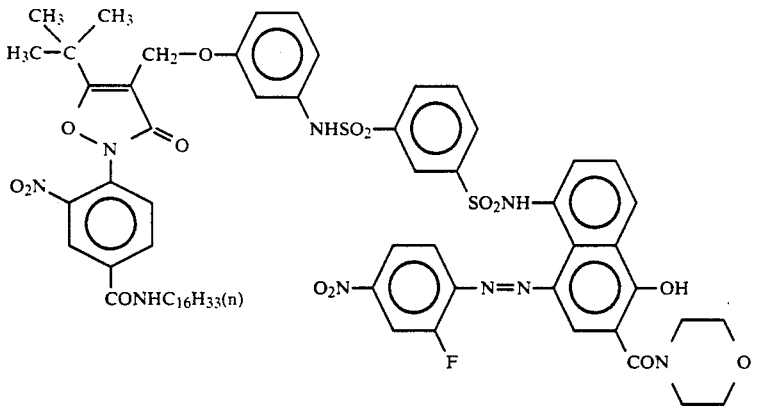

The synthesis of these compounds can be accomplished by any of the methods described in the above cited patents.

The amount of the dye-providing compound to be used depends on the absorptivity coefficient of dye but is normally in the range of 0.05 to 5 mmol/m$^2$, preferably 0.1 to 3 mmol/m$^2$. These dye-providing compounds can be used singly or in combination. In order to obtain an image with a black hue or different hue, two or more dye-providing compounds which release mobile dyes having different hues can be used in admixture. For example, at least one cyan dye-providing compound, one magenta dye-providing compound and one yellow dye-providing compound can be incorporated in a silver halide-containing layer or its adjacent layers in admixture.

In the present invention, electron donors and electron transfer agents (ETA) are used. These compounds are further described in EP-A-220746, and Kokai Giho 87-6199. Particularly preferred electron donors (or precursors thereof) are compounds represented by formulae (C) and (D): wherein $A_{101}$ and $A_{102}$ each represents a hydrogen atom or a protective group of phenolic hydroxyl group capable of deprotecting the nucleus by a nucleophilic reagent.

(C)

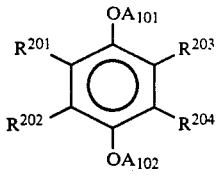

(D)

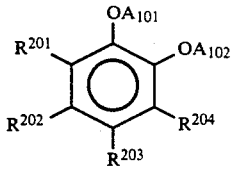

Examples of such a nucleophilic reagent include anionic reagents such as $OH^{\ominus}$, $RO^{\ominus}$, (R: alkyl group, aryl group), and hydroxamic anions ($SO_3^{2\ominus}$), and compounds containing lone pair such as primary or secondary amine, hydrazine, hydroxylamine, alcohol and thiol.

Preferred examples of $A_{101}$ and $A_{102}$ include hydrogen atom, acyl group, alkylsulfonyl group, arylsulfonyl group, alkoxycarbonyl group, aryloxycarbonyl group, dialkylphosphoryl group, diarylphosphoryl group, and protective group as described in JP-A-59-197037, and JP-A-59-20105. If possible, $A_{101}$ and $A_{102}$ may be connected to $R^{201}$, $R^{202}$, $R^{203}$ and $R^{204}$ to form a ring. $A_{101}$ and $A_{102}$ may be the same or different.

$R^{201}$, $R^{202}$, $R^{203}$ and $R^{204}$ each represents a hydrogen atom, alkyl group, aryl group, alkylthio group, arylthio group, sulfonyl group, sulfo group, halogen atom, cyano group, carbamoyl group, sulfamoyl group, amido group, imido group, carboxyl group or sulfonamido group. These groups may optionally contain substituents.

The total number of carbon atoms contained in $R^{201}$ to $R^{204}$ is 8 or more. In formula (C), $R^{201}$ and $R^{202}$ and/or $R^{203}$ and $R^{204}$ may be connected to each other to form a saturated or unsaturated ring. In formula (D), $R^{201}$ and $R^{202}$, $R^{202}$ and $R^{203}$ and/or $R^{204}$ may be connected to each other to form a saturated or unsaturated ring.

Preferred among the electron donors represented by formulae (C) and (D) are those wherein at least two of $R^{201}$ to $R^{204}$ are substituents other than hydrogen atom. Particularly preferred compounds are those wherein at least one of $R^{201}$ and $R^{202}$ and at least one of $R^{203}$ and $R^{204}$ are substituents other than hydrogen atom.

These electron donors can be used in combination. Alternatively, these electron donors may be used in combination with their precursors.

Specific examples of electron donors will be set forth below, but the present invention should not be construed as being limited thereto.

(ED-1)

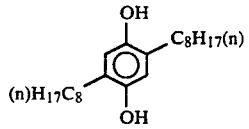

(ED-2)

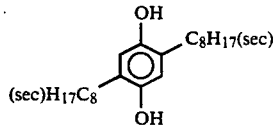

(ED-3)

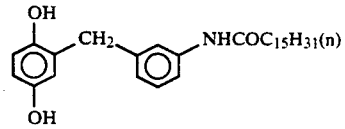

-continued (ED-4)

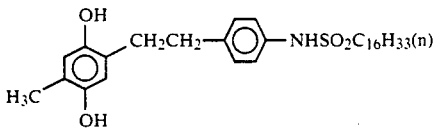

(ED-5)

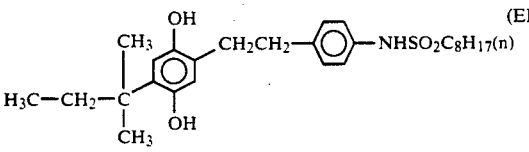

(ED-6)

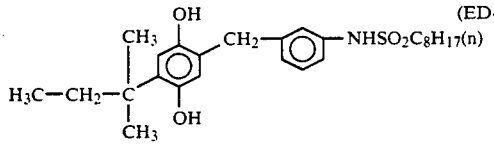

(ED-7)

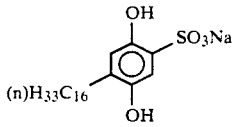

(ED-8)

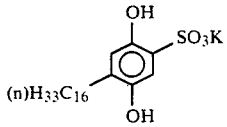

(ED-9)

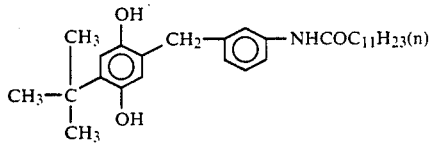

(ED-10)

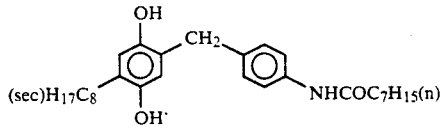

(ED-11)

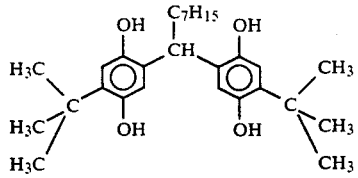

(ED-12)

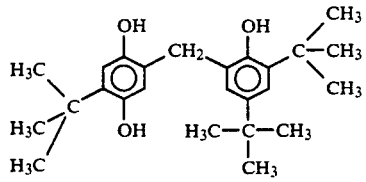

(ED-13)

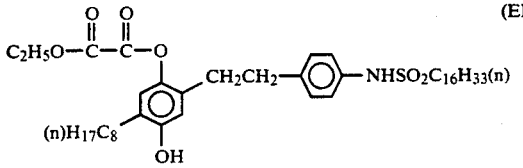

-continued (ED-14)

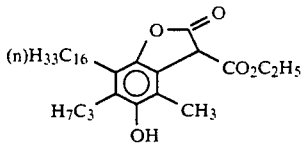

The amount of the electron donor (or precursor thereof) to be used can be in a wide range and is preferably in the range of 0.01 to 50 mol, particularly 0.1 to 5 mol per mol of positive dye-providing compound, or in the range of 0.001 to 5 mol, preferably 0.01 to 1.5 mol per mol of silver halide.

As ETA to be used in combination with these electron donors there can be used any compound which can be oxidized by silver halide to give an oxidation product capable of cross-oxidizing these electron donors. ETA is preferably mobile.

A particularly preferred ETA is a compound represented by formula (X-I) or (X-II):

(X-I)

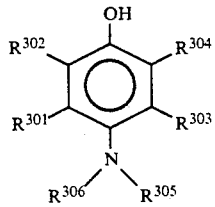

(X-II)

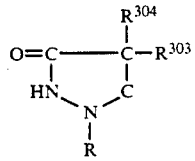

wherein R represents an aryl group; and $R^{301}$, $R^{302}$, $R^{303}$, $R^{304}$, $R^{305}$ and $R^{306}$ each represents a hydrogen atom, halogen atom, acylamino group, alkoxy group, alkylthio group, alkyl group or aryl group which may be substituted. $R^{301}$, $R^{302}$, $R^{303}$, $R^{304}$, $R^{305}$ and $R^{306}$ may be the same or different.

In the present invention, the compound represented by formula (X-II) is particularly preferred. In formula (X-II), $R^{301}$, $R^{302}$, $R^{303}$ and $R^{304}$ each preferably represents a hydrogen atom, $C_{1-10}$ alkyl group, $C_{1-10}$ substituted alkyl group or substituted or unsubstituted aryl group, more preferably a hydrogen atom, methyl group, hydroxymethyl group, phenyl group or phenyl group substituted by hydrophilic group such as hydroxyl group, alkoxy group, sulfo group and carboxyl group.

Specific examples of ETA will be set forth below, but the present invention should not be construed as being limited thereto.

(X-1)

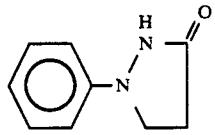

-continued
(X-2)
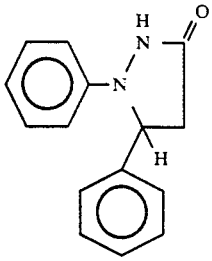
(X-3)
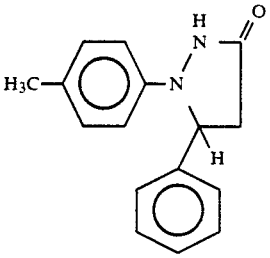
(X-4)
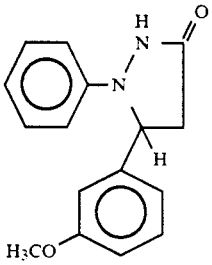
(X-5)
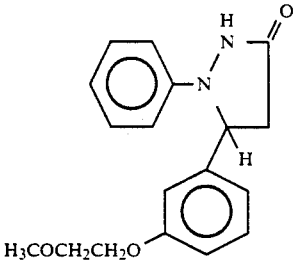
(X-6)
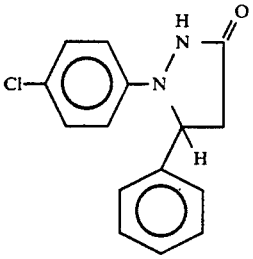
(X-7)
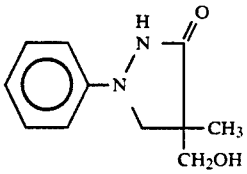
-continued
(X-8)
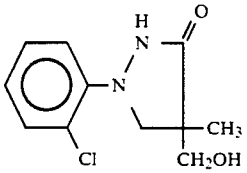
(X-9)
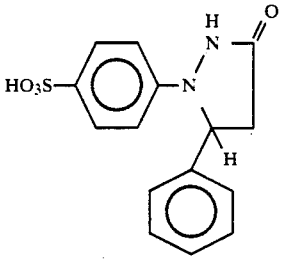
(X-10)
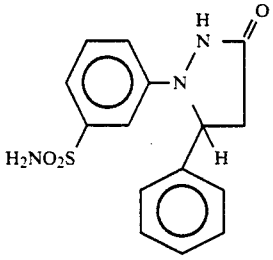
(X-11)
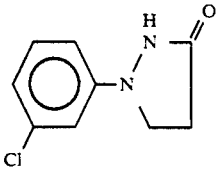
(X-12)
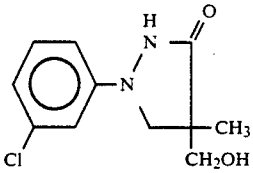
(X-13)
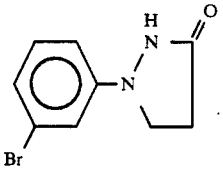
(X-14)
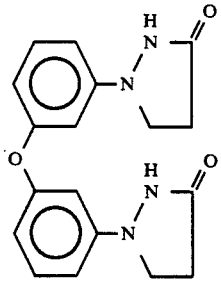
(X-15)
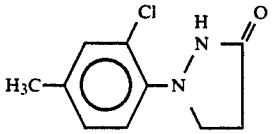

-continued

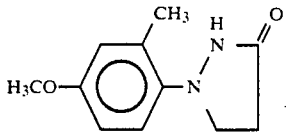

(X-16)

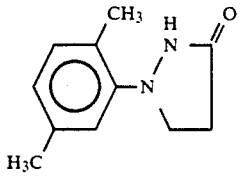

(X-17)

The ETA precursor to be used in the present invention is a compound which does not exhibit a developing effect during the storage of the light-sensitive material before use but can release ETA only when acted on by a proper activating agent (e.g., base, nucleating agent) or heat.

In particular, the ETA precursor to be used in the present invention comprises an ETA reactive functional group blocked by a blocking group. Such an ETA precursor does not serve as ETA but can serve as ETA when it undergoes cleavage of blocking group under an alkaline condition or under heating.

Examples of ETA precursors to be used in the present invention include 2- and 3-acyl derivatives of 1-phenyl-3-pyrazolidione, 2-aminoalkyl or hydroxylalkyl derivatives, salts of hydroquinone and catechol with metal (e.g., lead, cadmium, calcium, barium), halogenated acyl derivatives of hydroquinone, oxazine and bisoxazine derivatives of hydroquinone, lactone type ETA precursors, hydroquinone precursors containing quaternary ammonium group, cyclohexyl-2-ene-1,4-dione type compounds, compounds which undergo electron migration reaction to release ETA, compounds which undergo intramolecular nucleophilic substitution reaction to release ETA, ETA precursors blocked by phthalide group, and ETA precursors blocked by indomethyl group.

As ETA precursors to be used in the present invention there can be used known such compounds. Examples of such known compounds include developing agent precursors as described in U.S. Pat. Nos. 767,704, 3,241,967, 3,246,988, 3,295,978, 3,462,266, 3,586,506, 3,615,439, 3,650,749, 4,209,580, 4,330,617, and 4,310,612, British Patents 1,023,701, 1,231,830, 1,258,924, and 1,346,920, and JP-A-57-40245, JP-A-58-1139, JP-A-58-1140, JP-A-59-178458, JP-A-59-182449, and JP-A-59-182450.

Particularly preferred are precursors of 1-phenyl-3-pyrazolidione as described in JP-A-59-178458, JP-A-59-182449, and JP-A-59-182450.

ETA and ETA precursors can be used in combination.

In the present invention, a combination of electron donor and ETA is preferably incorporated in heat-developable color light-sensitive material. Two or more electron donors, ETA's and ETA precursors can be used in combination. Such a combination can be incorporated in each emulsion layer (e.g., blue-sensitive layer, green-sensitive layer, red-sensitive layer, infrared-sensitive layer, ultraviolet-sensitive layer) in the light-sensitive material, or may be incorporated in some of these emulsion layers, or may be incorporated in layers adjacent to these emulsion layers (e.g., antihalation layer, subbing layer, interlayer, protective layer). Such a combination may also be incorporated in all these layers. The electron donor and ETA can be incorporated in the same layer or different layers. These reducing agents can be incorporated in the same layer with or different layer from a dye-providing compound. The nondiffusion electron donor is preferably incorporated in the same layer with a dye-providing compound. ETA can be incorporated in an image-receiving material (dye-fixing layer). If a slight amount of water is allowed to be present in the system during heat development, ETA may be dissolved in this water. The total amount of electron donor, ETA or precursor thereof to be used is preferably in the range of 0.01 to 50 mol, more preferably 0.1 to 5 mol per mol of dye providing compound, or 0.001 to 5 mol, more preferably 0.01 to 1.5 mol per mol of silver halide.

The proportion of ETA in the total amount of reducing agents is in the range of 60 mol % or less, preferably 40 mol % or less. If ETA is supplied in the form of aqueous solution, the concentration of ETA is preferably in the range of $10^{-4}$ to 1 mol/l.

A compound capable of stabilizing images at the same time with the activation of development may be incorporated in the heat-developable light-sensitive material. Specific examples of such a compound which can be preferably used in the present invention are described in U.S. Pat. No. 4,500,626 (51st to 52nd columns).

In a system in which images are formed by diffusion transfer of dye, a light-sensitive material is used in combination with a dye-fixing material. The dye-fixing material may be coated on the same support as or different support from the light-sensitive material. As to the relationship of the light-sensitive material with the dye-fixing material, the support and the white reflective layer, those described in U.S. Pat. No. 4,500,626 (57th column) can be applied to the present invention.

The dye-fixing material which can be preferably used in the present invention comprises at least one layer containing a mordant and a binder. As such a mordant there can be used any mordant known in the field of photography. Specific examples of such a mordant include these described in U.S. Pat. No. 4,500,626, 58th to 59th columns, and JP-A-61-88256, pp. 32 to 41, and those described in JP-A-62-244043, and JP-A-62-244036. Other examples of mordants which can be used in the present invention include dye-accepting high molecular compounds as described in U.S. Pat. No. 4,463,079.

The dye-fixing material can comprise auxiliary layers such as protective layer, peel apart layer and anticurling layer as necessary. In particular, the protective layer can be advantageously provided.

The constituting layers of the light-sensitive material and dye-fixing material may comprise a high boiling organic solvent as a plasticizer, lubricant or agent for improving release of light-sensitive material from dye-fixing material. Specific examples of such a high boiling organic solvent include those described in JP-A-62-253159 (page 25), and JP-A-62-245253.

For the above described purposes, various silicone oils (all kinds of silicone oils ranging from dimethyl silicone oil to modified silicone oil comprising various organic groups incorporated in dimethylsiloxane) can be used. Examples of such silicone oils which can be effectively used include various modified silicone oils as described in Shin-Etsu Silicone Co., Ltd.'s technical data "Modified Silicone Oil", p. 6–18B. Particularly useful among these modified silicone oils, carboxy-modified silicone (trade name: X-22-3710) can be effectively used.

Other useful examples of such silicone oils include those described in JP-A-62-215953, and JP-A-63-46449.

In the present invention, the light-sensitive material and/or dye-fixing material may comprise an image formation accelerator. Such an image formation accelerator serves to accelerate redox reaction of a silver salt oxidizer with a reducer, formation or decomposition of a dye or release of a diffusive dye from a dye-donating substance, and transfer of a dye from the light-sensitive material layer to the dye-fixing layer. In the light of the physicochemical function, image formation accelerators are classified as base or base precursor, nucleophilic compound, high boiling organic solvent (oil), thermal solvent, surface active agent, and compound having interaction with silver or silver ion. However, these substance groups normally have composite functions and hence some of the above accelerating effects in combination. The details are described in U.S. Pat. No. 4,678,739 (38th to 40th columns).

Examples of base precursors which can be used in heat-developable light-sensitive material include salts of organic acids which undergo heat-decarboxylation with bases, and compounds which undergo intramolecular nucleophilic substitution reaction, Lossen rearrangement or Beckmann rearrangement to release amines. Specific examples of such base precursors are described in U.S. Pat. No. 4,511,493, and JP-A-62-65038.

In a system wherein the heat development and the dye transfer are simultaneously effected in the presence of water, a base and/or base precursor is preferably incorporated in the dye-fixing material in order to improve the preservability of the light-sensitive material.

In addition, a combination of a difficultly-soluble metallic compound and a compound capable of complexing metallic ions constituting the difficultly-soluble metallic compound (referred to as "complexing compound") as described in EP-A-210660 and U.S. Pat. No. 4,740,445, or compounds which undergo electrolysis to produce a base as described in JP-A-61-232451 may be used as base precursors. In particular, the former compounds are effective. The difficultly-soluble metallic compound and the complexing compound are preferably incorporated separately in the light-sensitive material and the dye-fixing material.

The light-sensitive material of the present invention and/or dye-fixing material may comprise various development stop agents for the purpose of keeping the image quality constant against the fluctuation in processing temperature and time during development.

The term "development stop agent" as used herein means a compound which readily neutralizes or reacts with a base after a proper development to decrease the base concentration in the film, thereby stopping development or a compound which interacts with silver or silver salt after a proper development to inhibit development. Specific examples of such a compound include acid polymers, nitrogen-containing heterocyclic compounds, mercapto compounds, and precursors thereof. Examples of such a compound which can be incorporated in a heat-developable light-sensitive material include acid precursors which release an acid when heated, and electrophilic compounds which undergo substitution reaction with a base present therewith when heated. These development stop agents are further described in JP-A-62-253159 (pp. 31 to 32).

In order to imagewise expose the light-sensitive material, various methods can be used. For example, a camera is used to directly photograph scenery or persons. In another process, the light-sensitive material is exposed to light through a reversal film or negative film by means of a printer or enlarger. In a process using an exposure apparatus in a copying machine, the light-sensitive material is exposed to light reflected from an original through a slit in a scanning manner. In another process, the light-sensitive material is exposed to light emitted from a light-emitting diode or a laser which has received an electrical signal representative of image data. Alternatively, the light-sensitive material is exposed directly or through an optical system to light from an image display apparatus such as CRT, liquid crystal display, electroluminescence display or plasma display which has received image data.

Examples of light sources to which the light-sensitive material is exposed to record images thereon include natural light, tungsten lamp, light-emitting diode, laser light source, CRT and other light sources as described in U.S. Pat. No. 4,500,626 (56th column).

Alternatively, a wavelength conversion element comprising a combination of a nonlinear optical element and a coherent light source such as laser light source can be used to imagewise expose the light-sensitive material. A nonlinear optical element is an element capable of exhibiting nonlinearity between polarization and electric field developed when a strong photoelectric field such as laser light is applied. As such a nonlinear optical element there can be used inorganic compound such as lithium niobate, potassium dihydrogenphosphate (KDP), lithium iodate, and $BaB_2O_4$, urea derivative, nitroaniline derivative, nitropyridine-N-oxide (POM) derivative such as 3-methyl-4-nitropyridine-N-oxide, or compound as described in JP-A-61-53462 and JP-A-62-210432. The above described wavelength conversion element has been known in the form of monocrystal light waveguide type element, fiber type element or the like. Any of these types of elements can be used in the present invention.

Examples of the above described image data which can be utilized in the present invention include image signal obtained from video camera, electronic steal camera, etc, television signal according to Nippon Television Signal Code (NTSC), image signal obtained by dividing an original into a large number of picture elements by a scanner or the like, and image signal obtained by a computer such as CG or CAD.

The processing of the heat-developable light-sensitive material will be set forth below.

The light-sensitive material and/or dye-fixing material may comprise an electrically-conductive heating layer as a heating means for heat development or dye diffusion transfer. As a transparent or opaque heating element there can be used a heating element as described in JP-A-61-145544. Such an electrically-conductive layer also serves as an antistatic layer.

The heating temperature at which the heat development can be effected is preferably in the range of about 50° to about 250° C., particularly about 80° to 180° C. The dye diffusion transfer process can be effected simultaneously with or after the heat development process. In the latter case, the heating temperature at which the transfer process can be effected is in the range of room temperature to the temperature range for the heat development process, particularly 50° C. to about 10° C. lower than the heating temperature used for the heat development process.

The transfer of a dye can be effected by the action of heat alone. The transfer of a dye can be accelerated by the use of a solvent.

As described in detail in JP-A-59-218443, and JP-A-61-238056, a process can be effectively used which comprises heating in the presence of a small amount of a solvent (particularly water) to simultaneously or sequentially effect development and transfer. In this process, the heating temperature is preferably in the range of 50° C. to the boiling point of the solvent. For example, if the solvent is water, the heating temperature is in the range of 50° C. to 100° C.

Examples of the solvent which can be used to accelerate development and/or transfer a diffusive dye to the dye-fixing layer include water, and a basic aqueous solution containing an inorganic alkaline metal salt or organic base as described with reference to image formation accelerators. Other example of solvents include a low boiling solvent, and a mixture of a low boiling solvent and water or a basic aqueous solution. These solvents can be used in the form of a mixture with a surface active agent, antifogging agent, difficultly-soluble metallic salt, complexing compound, or the like.

These solvents can be provided to either or both of the dye-fixing material and the heat-developable light-sensitive material. The amount of the solvent to be used may be as small as less than the weight of the solvent corresponding to the maximum swelling volume of all coat films (particularly less than the value obtained by subtracting the weight of all coat films from the weight of the solvent corresponding to the maximum swelling volume of all coat films).

The incorporation of the solvent in the light-sensitive layer or dye-fixing layer can be accomplished by a method as described in JP-A-61-147244 (p. 26). Alternatively, the solvent can be contained in microcapsules before being incorporated in either or both of the light-sensitive material and the dye-fixing material.

Alternatively, a process may be employed wherein a hydrophilic thermal solvent which stays solid at normal temperature but melts at an elevated temperature is incorporated in the light-sensitive material or dye-fixing material. Such a hydrophilic thermal solvent may be incorporated in either or both of the light-sensitive material and the dye-fixing material. The thermal solvent may be incorporated in any of emulsion layer, intermediate layer, protective layer and dye-fixing layer, preferably dye-fixing layer and/or its adjacent layers.

Examples of such a hydrophilic thermal solvent include ureas, pyrimidines, amides, sulfonamides, imides, alcohols, oximes, and other heterocyclic groups.

In order to accelerate the transfer of a dye, a high boiling organic solvent may be incorporated in the heat-developable light-sensitive material and/or dye-fixing material. The heating at the development process and/or transfer process can be accomplished by bringing the material into contact with a heated block or plate, heating plate, hot presser, heat roller, halogen lamp heater, infrared or far infrared lamp heater or the like or by passing the material through an elevated temperature atmosphere.

For pressure conditions and pressing methods in case whese the heat-developable light-sensitive material and the dye-fixing material are brought into close contact with each other to form a lamination, those described in JP-A-61-147244 (page 27) can be applied to the present invention.

For the processing of the heat-developable light-sensitive element of the present invention, any of various heat developing apparatus can be used. For example, any apparatus described in JP-A-59-75247, JP-A-59-177547, JP-A-59-181353, and JP-A-60-18951, and JP-A-U-62-25944 (the term "JP-A-U" as used herein means an "unexamined published Japanese utility model application") can be preferably used.

The present invention will be further described in the following examples, but the present invention should not be construed as being limited thereto.

EXAMPLE 1

The preparation of a silver halide emulsion (I) for the 5th layer will be described hereinafter.

300 ml of an aqueous solution of 50 g of silver nitrate and 300 ml of an aqueous solution of halide (22.8 g of KBr and 6 g of NaCl) were simultaneously added to an aqueous solution of gelatin (obtained by dissolving 20 g of lime-processed deionized bone gelatin (Ca content: 20 ppm), 4 g of sodium chloride, 0.1 g of potassium bromide, and 0.015 g of a compound of formula:

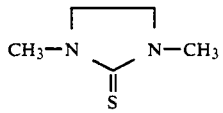

in 800 ml of water, and then keeping the solution at a temperature of 65° C.) with vigorous stirring for 30 minutes. The solution was then cooled down to a temperature of 35° C. 300 ml of an aqueous solution of 50 g of silver nitrate and 300 ml of an aqueous solution of halide (31.5 g of KBr and 1.7 g of NaCl) were simultaneously added to the solution in 30 minutes.

After being washed with water and desalted, there were added to the solution 25 g of lime-processed bone gelatin (guanine content: 50 ppm) and 100 ml of water so that the pH value and the pAg value thereof reached 6.3 and 7.9, respectively.

The resulting emulsion was then subjected to optimum chemical sensitization with 0.8 mg of trimethylthiourea and 100 mg of 4-hydroxy-6-methyl-1,3,3a,7-tetrazaindene at a temperature of 55° C. The yield of the desired emulsion was 650 g.

The preparation of a silver halide emulsion (II) for the 3rd layer will be described hereinafter.

600 ml of an aqueous solution of 100 g of silver nitrate and 600 ml of an aqueous solution of halide (54.5 g of KBr and 2 g of NaCl) were simultaneously added to an aqueous solution of lime-processed bone gelatin (ash content: 0.4%; adenine content: 0.2 ppm) (obtained by dissolving 50 g of gelatin, 10 g of sodium chloride, 0.1 g of potassium bromide, and 5 cc of 1N sodium hydroxide in 800 ml of water, and then keeping the solution at a temperature of 60° C.) with vigorous stirring for 30 minutes. 1 minute after the completion of the addition, a dye solution obtained by dissolving 0.2 g of a sensitizing dye (A) and 0.2 g of a sensitizing dye (B) in 120 ml of water and 120 ml of methanol was added to the solution. After 5 minutes, 10 ml of a 1% aqueous solution of potassium iodide was added to the solution.

Sensitizing Dye (A)

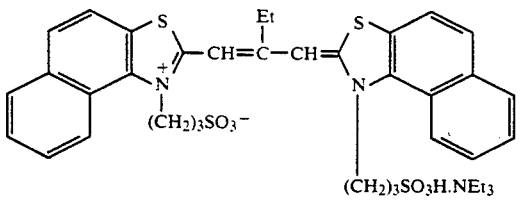

Sensitizing Dye (B)

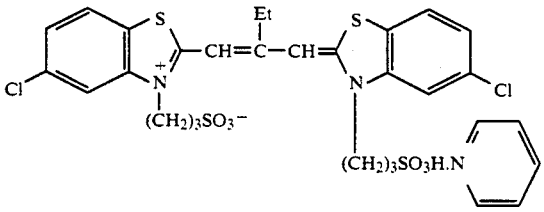

After being washed with water and desalted, there were added to the solution 10 g of lime-processed bone gelatin (adenine content: 20 ppm) and 50 ml of water so that the pH value and the pAg value thereof reached 6.0 and 7.6, respectively.

The resulting emulsion was then subjected to chemical ripening with 2.5 mg of hypo at a temperature of 60° C. over 50 minutes. The yield of the desired emulsion was 500 g.

The preparation of a silver halide emulsion (III) for the 1st layer will be described hereinafter.

Solution I and Solution II simultaneously began to be added to an aqueous solution of lime-processed bone gelatin (Ca content: 2,500 ppm) (obtained by dissolving 20 g of gelatin, 2 g of sodium chloride, and 0.015 g of a compound of the general formula:

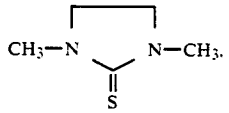

in 800 ml of water, and then keeping the solution at a temperature of 50° C.) with vigorous stirring over 12 minutes and 8 minutes, respectively. 16 minutes after the completion of the addition of Solution I, Solution IV was added to the solution over 44 minutes. 20 minutes after the completion of the addition of Solution I, Solution III was added to the solution over 40 minutes. The system exhibited a pH value of 6.7 between the completion of the addition of Solution I and the beginning of the addition of Solution III.

| | Solution I (100 ml as a whole) | Solution II (60 ml as a whole) | | Solution III (500 ml as a whole) | Solution IV (540 ml as a whole) | |
|---|---|---|---|---|---|---|
| | $AgNO_3$ (g) | KBr (g) | NaCl (g) | $AgNO_3$ (g) | KBr (g) | NaCl (g) |
| Emulsion III | 15 | 4.9 | 1 | 85 | 44.1 | 9 |

After being washed with water and desalted, there were added to the solution 25 g of lime-processed bone gelatin (Ca content: 4,000 ppm) and 100 ml of water so that the pH value and the pAg value thereof reached 6.0 and 7.7, respectively. The resulting emulsion was then subjected to optimum chemical sensitization with 1.1 mg of triethylthiourea and 60 mg of 4-hydroxy-6-methyl-1,3,3a,7-tetrazaindene at a temperature of 55° C. The yield of the desired emulsion was 650 g.

The preparation of organic silver salts will be described hereinafter.

Organic Silver Salt (1)

The preparation of a benzotriazole silver emulsion will be described hereinafter.

28 g of gelatin and 13.2 g of benzotriazole were dissolved in 300 ml of water. The solution was then stirred at a temperature of 40° C. A solution of 17 g of silver nitrate in 100 ml of water was added to the solution.

The pH value of the benzotriazole silver emulsion was adjusted to precipitate excess salt. The excess salt was then removed. The pH value of the emulsion was adjusted to 6.30 to obtain a benzotriazole silver emulsion (yield: 400 g).

Organic Silver Salt (2)

20 g of gelatin and 5.9 g of 4-acetylaminophenylpropiolic acid were dissolved in 1,000 ml of a 0.1% aqueous solution of sodium hydroxide and 200 ml of ethanol.

The solution was then stirred at a temperature of 40° C.

A solution of 4.5 g of silver nitrate in 200 ml of water was added to the solution over 5 minutes.

The pH value of the dispersion was properly adjusted to precipitate excess salt. The excess salt was then removed. The pH value of the dispersion was adjusted to 6.3 to obtain a dispersion of an organic silver salt (2) (yield: 300 g).

The preparation of gelatin dispersions of dye-providing compounds will be described hereinafter.

15 g of a yellow dye-providing compound (A), 1.2 g of a reducing agent, 0.3 g of a mercapto compound (1), 1.5 g of a surface active agent (4), and 7.5 g of a high boiling organic solvent (1) were measured out. These materials were then dissolved in 45 ml of ethyl acetate at a temperature of about 60° C. to obtain a homogeneous solution. The solution, 100 g of a 10% solution of lime-processed gelatin, and 30 ml of water were mixed with stirring. The material was then subjected to dispersion at 10,000 rpm in a homogenizer over 10 minutes. The dispersion was used as a dispersion of a yellow dye-providing compound.

15 g of a magenta dye-providing compound (B), 0.6 g of a reducing agent, 0.15 g of a mercapto compound (1), 1.5 g of a surface active agent (4), and 5.3 g of a high boiling organic solvent (2) were measured out. These materials were then dissolved in 25 ml of ethyl acetate at a temperature of about 60° C. to obtain a homogeneous solution. The solution, 100 g of a 10% solution of lime-processed gelatin, and 30 ml of water were mixed with stirring. The material was then subjected to dispersion at 10,000 rpm in a homogenizer over 10 minutes. The dispersion was used as a dispersion of a magenta dye-providing compound.

15 g of the cyan dye-providing compound (C), 0.8 g of a reducing agent, 0.6 g of the mercapto compound (1), 1.5 g of the surface active agent (4), and 8.3 g of the high boiling organic solvent (1) were measured out. These materials were then dissolved in 30 ml of ethyl acetate at a temperature of about 60° C. to obtain a homogeneous solution. The solution, 100 g of a 10% solution of lime-processed gelatin, and 30 ml of water were mixed with stirring. The material was then subjected to dispersion at 10,000 rpm in a homogenizer over 10 minutes. The dispersion was used as a dispersion of a cyan dye-providing compound.

A heat-developable light-sensitive material 100 was prepared from these materials as set forth in the table below.

Heat developable light-sensitive material 100

| Layer No. | Layer name | Additive | Added Amount ($g/m^2$) |
|---|---|---|---|
| 6th Layer | Protective layer | Gelatin | 0.72 |
| | | Matting agent | 0.023 |
| | | Water-soluble polymer (1) | 0.18 |
| | | Surface active agent (1) | 0.051 |
| | | Surface active agent (2) | 0.090 |
| | | Surface active agent (3) | 0.029 |
| | | Hardening agent | 0.049 |
| 5th Layer | Green-sensitive layer | Emulsion (I) | Amount of silver 0.27 |
| | | Benzotriazole | $4.4 \times 10^{-3}$ |
| | | Sensitizing dye (1) | $9.5 \times 10^{-4}$ |
| | | Yellow dye-providing compound (A) | 0.29 |
| | | High boiling organic solvent (1) | 0.15 |
| | | Reducing agent | 0.023 |
| | | Mercapto compound (1) | $5.8 \times 10^{-3}$ |
| | | Surface active agent (4) | 0.032 |
| | | Gelatin | 0.42 |
| | | Water-soluble polymer (2) | |
| 4th Layer | Interlayer | Gelatin | 0.56 |
| | | $Zn(OH)_2$ | 0.24 |
| | | Benzotriazole | $3.4 \times 10^{-3}$ |
| | | Surface active agent (1) | $8.8 \times 10^{-3}$ |
| | | Surface active agent (5) | $4.6 \times 10^{-3}$ |
| | | Water-soluble polymer (2) | 0.010 |
| 3rd Layer | Red-sensitive layer | Emulsion (II) | Amount of silver 0.1 |
| | | Organic silver salt (1) | Amount of silver $3.8 \times 10^{-3}$ |
| | | Organic silver salt (2) | Amount of silver 0.016 |
| | | Magenta dye-providing compound (B) | 0.24 |
| | | High boiling organic solvent (2) | 0.08 |
| | | Reducing agent | $9.5 \times 10^{-3}$ |
| | | Mercapto compound (1) | $2.4 \times 10^{-3}$ |
| | | Surface active agent (5) | 0.023 |
| | | Gelatin | 0.31 |
| | | Water-soluble polymer (2) | $7.4 \times 10^{-3}$ |
| | | Surface active agent (4) | 0.026 |
| 2nd Layer | Interlayer | Gelatin | 0.62 |
| | | $Zn(OH)_2$ | 0.19 |
| | | Surface active agent (1) | $5.9 \times 10^{-3}$ |
| | | Surface active agent (5) | $3.2 \times 10^{-3}$ |
| | | Surface active agent (6) | 0.056 |
| | | Water-soluble polymer (2) | $4.5 \times 10^{-3}$ |
| 1st Layer | Red-sensitive layer | Emulsion (III) | Amount of silver 0.20 |
| | | Organic solver salt (1) | Amount of silver 0.032 |
| | | Organic silver salt (2) | Amount of silver 0.016 |
| | | Mercapto compound (2) | $5.8 \times 10^{-4}$ |
| | | Sensitizing dye (2) | $2.5 \times 10^{-5}$ |
| | | Cyan dye-providing compound (C) | 0.26 |
| | | High boiling organic solvent (1) | 0.14 |
| | | Reducing agent | 0.014 |
| | | Mercapto compound (1) | 0.011 |
| | | Surface active agent (4) | 0.029 |
| | | Surface active agent (5) | $8.1 \times 10^{-3}$ |
| | | Gelatin | 0.28 |
| | | Water-soluble polymer (2) | 0.014 |
| Support (polyethylene terephthalate: 100 μm thick) | | | |
| Backing Layer | | Carbon black | 0.44 |
| | | Polyvinyl chloride | 0.30 |

Yellow dye-providing compound(A):

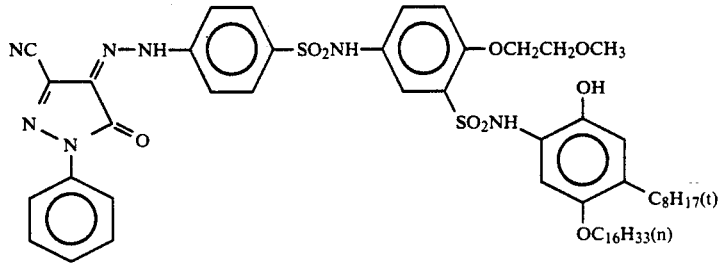

Magents dye-providing compound (B):

-continued
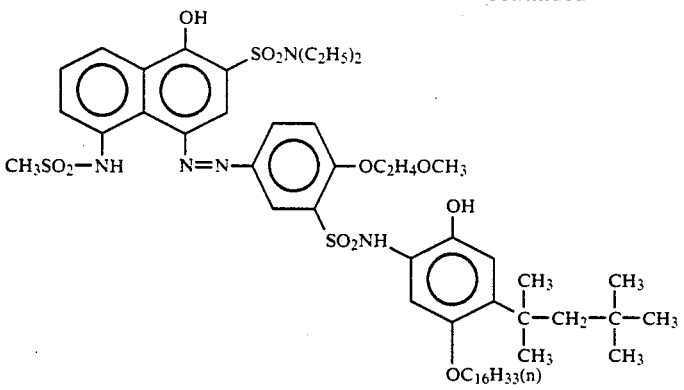
Cyan dye-providing compound (C):
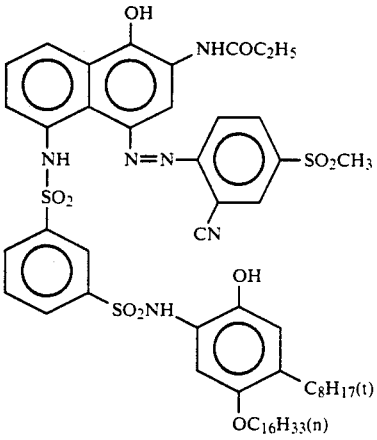
Water-soluble polymer (1):
Sumikagel L-5 (H) (Sumitomo Chemical Co., Ltd.)
Water-soluble polymer (2):
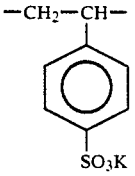
Surface active agent (1):
Aerosol OT
Surface active agent (2):
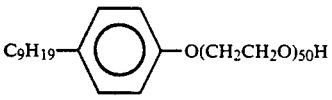
Surface active agent (3):
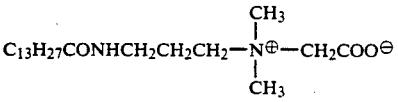
Surface active agent (4):
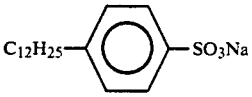
Surface active agent (5):

-continued

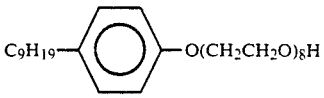

Surface active agent (6):

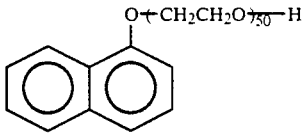

Hardening agent:

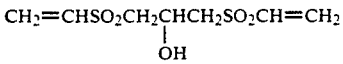

Sensitizing dye (1)

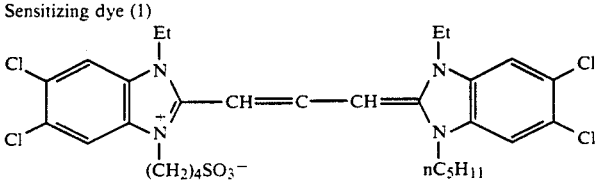

Sensitizing dye (2)

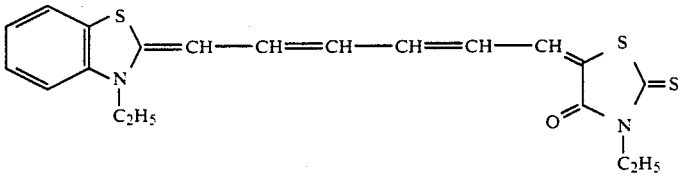

Reducing agent

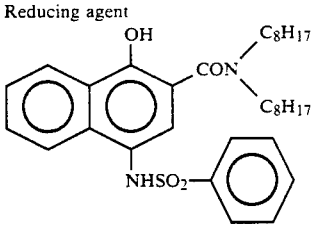

Mercapto compound (1):

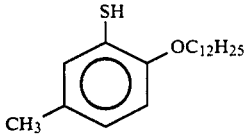

Mercapto compound (2):

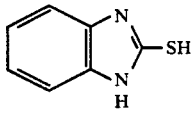

High boiling organic solvent (1):
Triisononyl phosphate

High boiling organic solvent (2):
Trihexyl phosphate

A light-sensitive material Specimen 101 was prepared in the same manner as in Specimen 100 except that the following compound A was each incorporated in the 3rd layer and the 5th layer in an amount of 0.015 g/m$^2$.

Compound (A):

-continued

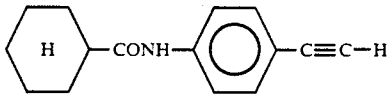

Light-sensitive material Specimens 102 to 110 were prepared in the same manner as in Specimen 100 except that the compounds of the present invention were incorporated in the 3rd layer and the 5th layer as set forth in Table 1, respectively.

The preparation of a dye-fixing material will be described hereinafter.

A dye-fixing material R-1 was prepared by coating the following compositions on a polyethylene-laminated paper support.

Structure of dye-fixing material R-1

| Layer No. | Additive | Added Amount ($g/m^2$) |
|---|---|---|
| 3rd Layer | Gelatin | 0.05 |
| | Silicone oil*1 | 0.04 |
| | Surface active agent*2 | 0.001 |
| | Surface active agent*3 | 0.02 |
| | Surface active agent*4 | 0.10 |
| | Guanidine picrate | 0.45 |
| | Polymer*5 | 0.24 |
| 2nd Layer | Mordant*6 | 2.35 |
| | Polymer*7 | 0.60 |
| | Gelatin | 1.40 |
| | Polymer*5 | 0.21 |
| | High boiling solvent*8 | 1.40 |
| | Guanidine picrate | 1.80 |
| | Surface active agent*2 | 0.02 |
| 1st Layer | Gelatin | 0.45 |
| | Surface active agent*4 | 0.01 |
| | Polymer*5 | 0.04 |
| | Hardening agent*9 | 0.30 |
| Polyethylene-laminated paper support (thickness: 170 μm) | | |
| 1st backing Layer | Gelatin | 3.25 |
| | Hardening agent*9 | 0.25 |
| 2nd backing Layer | Gelatin | 0.44 |
| | Silicone oil*1 | 0.08 |
| | Surface active agent*2 | 0.002 |
| | Matting agent*10 | 0.09 |
| | Surface active agent*11 | 0.01 |

Silicone oil *1:

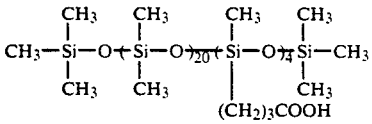

Surface active agent *2:
Aerosol OT
Surface active agent *3:

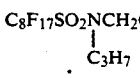

Surface active agent *4:

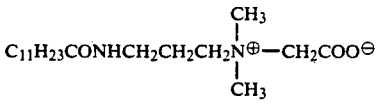

Surface active agent *11:

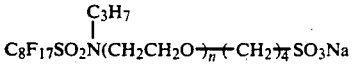

(n: about 4)

-continued

Polymer *5:
Vinyl alcohol-sodium acrylate copolymer (molar proportion: 75/25)
Polymer *7:
Dextran (molecular weight: 70,000)
Mordant *6:

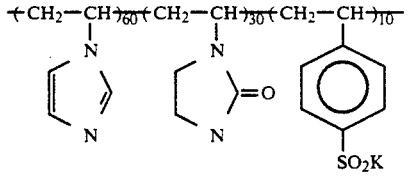

High boiling solvent *8:
Leofos 95 (Ajinomoto Co., Inc.)
Hardening agent *9:

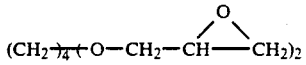

Matting agent *10:
Benzoguanamine resin (proportion of grains having a diameter of more than 10 μm; 18 vol %)

These multilayer color light-sensitive materials were then exposed to light with 500 lux from a tungsten lamp through a G, R and IR separation filter (G: 500 to 600 nm; R: 600 to 700 nm; IR: 700 nm or more) having a gradual density over 1 second. Water was then supplied to the emulsion surface of these heat-developable light-sensitive materials thus exposed by means of a wire bar in an amount of 15 $ml/m^2$. These heat-developable light-sensitive materials were laminated with the dye-fixing material R-1 in such a manner that the film surface thereof were brought into contact with each other.

These laminations were heated for 25 seconds over a heat roller which had been temperature-adjusted so that the temperature of the water-absorbed film reached 93° C. The dye-fixing material was then peeled off the light-sensitive materials to obtain sharp yellow, magenta and cyan images corresponding to the G, R and IR separation filters on the dye-fixing material. These images were measured for the density of yellow and magenta dye images by means of a macbeth reflective densitometer (RD-519). The results are set forth in Table 1.

TABLE 1

| Light-sensitive material | Compound added to 3rd and 5th layers | Added amount ($mg/m^2$) | Yellow | | Magenta | |
|---|---|---|---|---|---|---|
| | | | $D_{min}$ | $D_{max}$ | $D_{min}$ | $D_{max}$ |
| 100 (Comparative) | — | — | 0.26 | 1.98 | 0.32 | 1.96 |
| 101 (Comparative) | A | 30.0 | 0.18 | 1.78 | 0.19 | 1.74 |
| 102 (Present Invention) | 5 | 1.9 | 0.16 | 1.92 | 0.16 | 1.96 |
| 103 (Present Invention) | 7 | 1.4 | 0.16 | 1.92 | 0.15 | 1.96 |
| 104 (Present Invention) | 11 | 2.0 | 0.15 | 1.99 | 0.16 | 2.01 |
| 105 (Present Invention) | 13 | 1.4 | 0.15 | 1.94 | 0.16 | 1.98 |
| 107 (Present Invention) | 16 | 1.8 | 0.17 | 2.00 | 0.16 | 1.94 |
| 108 (Present Invention) | 18 | 1.2 | 0.16 | 1.96 | 0.15 | 1.98 |
| 109 (Present Invention) | 20 | 1.2 | 0.15 | 1.92 | 0.15 | 1.94 |
| 110 (Present | 28 | 1.4 | 0.15 | 1.90 | 0.14 | 1.92 |

TABLE 1-continued

| Light-sensitive material | Compound added to 3rd and 5th layers | Added amount (mg/m²) | Yellow $D_{min}$ | Yellow $D_{max}$ | Magenta $D_{min}$ | Magenta $D_{max}$ |
|---|---|---|---|---|---|---|
| Invention) | | | | | | |

Table 1 shows that the use of the compounds of the present invention provides heat-developable light-sensitive materials which exhibit a low fog density.

EXAMPLE 2

A monodisperse gelatin emulsion of tetradecahedral silver bromide grains (mean grain size: about 0.8 μm) was subjected to ripening with diphenylthiourea, potassium chloroaurate and ammonium thiocyanate. Potassium iodide was then added to the emulsion in an amount of 0.1 mol %. 3,3'-Disulfopropyl-5-5'-dichloro-9-ethyl-oxacarbocyanine sodium salt was added to the emulsion. The compounds of the present invention and comparative compounds were added to the emulsion as set forth in Table 2, respectively. A coating aid (sodium dodecylbenzenesulfonate) and a hardening agent (2,4-dichloro-6-hydroxy-s-triazine) were added to the emulsions. These emulsions were then coated on a cellulose triacetate support, and dried to obtain Specimens 201 to 207. These specimens were then exposed to light through an optical wedge with a yellow filter by means of a sensitometer over 1/20 second, developed with a PQ developer having the following composition at a temperature of 35° C. over 35 seconds, fixed, washed with water, dried, and measured for photographic properties (sensitivity and fog). The results are set forth in Table 2.

The photographic sensitivity is represented as the reciprocal of the logarithm of the exposure required to obtain an optical density (fog +0.2). In Table 2, the sensitivity of these specimens are represented relative to that of Specimen 201 as 100.

| Composition of developer | |
|---|---|
| Sodium sulfite | 40 g |
| Hydroquinone | 25 g |
| Boric acid | 10 g |
| 1-Phenyl-3-pyrazolidone | 1.5 g |
| Potassium hydroxide | 30 g |
| 5-Methylbenzotriazole | 0.15 g |
| Glutaraldehyde bisulfite | 15 g |
| Acetic acid | 12 g |
| Potassium bromide | 10 g |
| Water to make | 1 l |

TABLE 2

| | Light-sensitive material | Compound | Added amount (molar amount per mol of silver halide) | Fog | Relative sensitivity |
|---|---|---|---|---|---|
| 201 | (Comparative) | — | — | 0.27 | 100 |
| 202 | (Comparative) | B* | $1.2 \times 10^{-3}$ | 0.21 | 57 |
| 203 | (Comparative) | C** | $1.0 \times 10^{-3}$ | 0.26 | 88 |
| 204 | (Present Invention) | 5 | $0.8 \times 10^{-3}$ | 0.15 | 105 |
| 205 | (Present Invention) | 7 | $0.8 \times 10^{-3}$ | 0.16 | 110 |
| 206 | (Present Invention) | 13 | $1.0 \times 10^{-3}$ | 0.15 | 110 |
| 207 | (Present Invention) | 27 | $1.0 \times 10^{-3}$ | 0.14 | 94 |

*Comparative Compound B

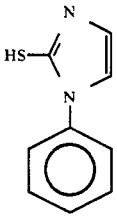

**Comparative Compound C

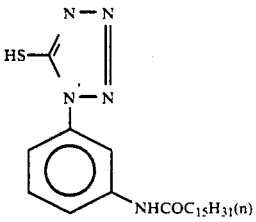

Table 2 shows that the specimens comprising the compounds of the present invention exhibit no drop in relative sensitivity and an effective drop in fog density as compared to the specimens comprising Comparative Compounds B and C.

EXAMPLE 3

A gelatin emulsion of silver bromoiodide grains (mean grain size: 0.5 μm) containing 5 mol % of silver bromide was subjected to ripening with sodium thiosulfate at a temperature of 60° C. over 60 minutes.

To the emulsion were added the compounds of the present invention and comparative compounds as set forth in Table 3, respectively. The coupler, spectral sensitizer, hardening agent and coating aid set forth below were added to the emulsions. The emulsions were coated on a support and dried to obtain Specimens 301 to 306. These specimens were then exposed to light through a yellow filter over 1/20 second, subjected to the following color development, and measured for photographic properties. The results are set forth in Table 3.

In Table 3, the sensitivity is represented as in Example 1. The sensitivity of these specimens are represented relative to that of Specimen 301 (shortly after coating) as 100.

| | |
|---|---|
| 1. Color Development | 2 min. 45 sec. (38° C.) |
| 2. Bleach | 6 min. 30 sec. |
| 3. Rinse | 3 min. 15 sec. |
| 4. Fixing | 6 min. 30 sec. |
| 5. Rinse | 3 min. 15 sec. |
| 6. Stabilizing | 3 min. 15 sec. |

The composition of the processing solutions used at the various steps are as follows:

| Color Developer | |
|---|---|
| Sodium nitrilotriacetate | 1.0 g |
| Sodium sulfite | 4.0 g |
| Sodium carbonate | 30.0 g |
| Potassium bromide | 1.4 g |

-continued

| | |
|---|---|
| Hydroxylamine sulfate | 2.4 g |
| 4-(N-ethyl-N-β-hydroxyethylamino-2-methyl-aniline) sulfate | 4.5 g |
| Water to make | 1 l |
| Bleaching Solution | |
| Ammonium bromide | 160.0 g |
| 28% Aqueous ammonia | 25.0 ml |
| Sodium ethylenediamine-tetraacetato ferrate | 130.0 g |
| Glacial acetic acid | 14.0 ml |
| Water to make | 1 l |
| Fixing Solution | |
| Sodium tetrapolyphosphate | 2.0 g |
| Sodium sulfite | 4.0 g |
| 70% Ammonium thiosulfate | 175.0 ml |
| Sodium bisulfite | 4.6 g |
| Water to make | 1 l |
| Stabilizing Solution | |
| Formalin | 8.0 ml |
| Water to make | 1 l |

Additive

| | |
|---|---|
| Coupler: | 1-(2,4,6-Trichlorophenyl)-3-[3-(2,4-di-t-amylphenoxy) acetamido]benzamido-5-pyrazlone |
| Spectral sensitizer: | Bis-[2-{1-ethyl-3-(3-sulfopropyl)-5,6-dichloro-benzimidazole}]trimethinecyanine sodium salt |
| Hardening agent: | 2,4-Dichloro-6-hydroxy-1,3,5-triazine sodium salt |
| Coating aid: | Sodium p-dodecylbenzenesulfonate<br>Sodium p-nonylphenoxypoly(ethyleneoxy)propane-sulfonate |

TABLE 3

| Light-sensitive material | Compound | Added amount (molar amount per mol of silver halide) | Fog | Relative Sensitivity |
|---|---|---|---|---|
| 301 (Comparative) | — | — | 0.24 | 100 |
| 302 (Comparative) | B* | $1.2 \times 10^{-3}$ | 0.20 | 63 |
| 303 (Present Invention) | 1 | $0.8 \times 10^{-3}$ | 0.13 | 130 |
| 304 (Present Invention) | 5 | $0.8 \times 10^{-3}$ | 0.12 | 125 |
| 305 (Present Invention) | 18 | $0.6 \times 10^{-3}$ | 0.14 | 110 |
| 206 (Present Invention) | 29 | $1.0 \times 10^{-3}$ | 0.13 | 110 |

* Same as set forth in Table 2

Table 3 shows that the compounds of the present invention exhibit no drop in relative sensitivity and an effective drop in fog density in color development as compared to the specimens comprising Comparative Compound B.

EXAMPLE 4

(1) Preparation of silver halide emulsions

Emulsion (I)

Solution (1) and Solution (2) described later were simultaneously added to an aqueous solution of gelatin (obtained by dissolving 20 g of gelatin, 3 g of potassium bromide, and 0.3 g of $HO(CH_2)_2S(CH_2)_2S(CH_2)_2OH$ in 800 ml of water, and then keeping the solution at a temperature of 55° C.) with vigorous stirring over 30 minutes. Solution (3) and Solution (4) described later were then simultaneously added to the system over 20 minutes. 5 minutes after the beginning of the addition of Solution (3), a dye solution described later was added to the system over 18 minutes.

After being washed with water and desalted, there was added to the emulsion 20 g of lime-processed osein gelatin so that the pH value and pAg value thereof reached 6.2 and 8.5, respectively. The emulsion was then subjected to optimum chemical sensitization with sodium thiosulfate, 4-hydroxy-6-methyl-1,3,3a,7-tetrazaindene, and chloroauric acid. As a result, 600 g of a monodisperse emulsion of tetradecahedral silver bromoiodide grains having an average size of 0.40 μm was obtained.

| | Solution (1) Water to make 180 ml | Solution (2) Water to make 180 ml | Solution (3) Water to make 350 ml | Solution (4) Water to make 350 ml |
|---|---|---|---|---|
| $AgNO_3$ | 30 g | — | 70 g | — |
| KBr | — | 20 g | — | 49 g |
| KI | — | 1.8 g | — | — |

Dye solution: Obtained by dissolving 0.12 g of:

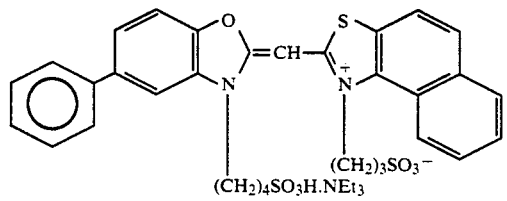

and 0.12 g of:

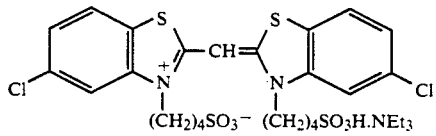

in 160 ml of methanol

Emulsion (II)

Solution (I) and Solution (II) set forth in Table 5 were added to an aqueous solution of gelatin (set forth in Table 4) with vigorous stirring at a temperature of 50° C. over 30 minutes. Solution (III) and Solution (IV) set forth in Table 5 were then added to the system over 30 minutes. 1 minute after the completion of the addition of these solutions, a dye solution set forth in Table 6 was added to the system.

TABLE 4

| | |
|---|---|
| Gelatin | 20 g |
| NaCl | 6 g |
| KBr | 0.3 g |
| 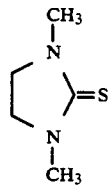 | 0.015 g |
| $H_2O$ | 730 ml |

TABLE 5

| | (I) | (II) | (III) | (IV) |
|---|---|---|---|---|
| $AgNO_3$ | 50 g | — | 50 g | — |
| KBr | — | 21 g | — | 28 g |

TABLE 5-continued

| | (I) | (II) | (III) | (IV) |
|---|---|---|---|---|
| NaCl | — | 6.9 g | — | 3.5 g |
| $H_2O$ to make | 200 ml | 200 ml | 200 ml | 200 ml |

TABLE 6

(Composition of dye solution)

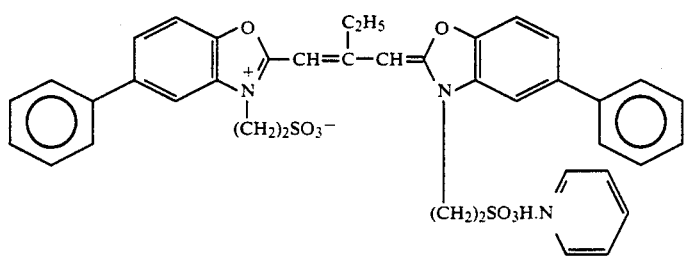

0.23 g

Methanol 154 ml

After being washed with water and desalted, there was added to the emulsion 20 g of gelatin so that the pH value and pAg value thereof were properly adjusted. The emulsion was then subjected to optimum chemical sensitization with triethylthiourea, chloroauric acid, and 4-hydroxy-6-methyl-1,3,3a,7-tetrazaindene.

As a result, 630 g of a monodisperse emulsion of cubic grains having a size of 0.40 μm was obtained.

Emulsion (III)

Solution (I) and Solution (II) described later were simultaneously added to an aqueous solution of gelatin (obtained by dissolving 20 g of gelatin, 0.3 g of potassium bromide, 6 g of sodium chloride, and 30 mg of a chemical A described later in 800 ml of water, and then keeping the solution at a temperature in 50° C.) at an equal flow rate with vigorous stirring over 30 minutes. Solution (III) and Solution (IV) described later were then simultaneously added to the system over 30 minutes. 3 minutes after the completion of the addition of these solutions, a dye solution described later was added to the system over 20 minutes.

After being washed with water and desalted, there was added to the emulsion 22 g of lime-processed osein gelatin so that the pH value and pAg value thereof were adjusted to 6.2 and 7.7, respectively. The emulsion was then subjected to optimum chemical sensitization with sodium thiosulfate, 4-hydroxy-6-methyl-1,3,3a,7-tetrazaindene, and chloroauric acid at a temperature of 60° C. As a result, 635 g of a monodisperse emulsion of cubic silver bromochloride grains having an average size of 0.38 μm was obtained.

| | Solution (I) Water to make 200 ml | Solution (II) Water to make 200 ml |
|---|---|---|
| $AgNO_3$ | 50.0 g | — |
| KBr | — | 28.0 g |
| NaCl | — | 3.4 g |

| | Solution (III) Water to make 200 ml | Solution (IV) Water to make 200 ml |
|---|---|---|
| $AgNO_3$ | 50.0 g | — |
| KBr | — | 35.0 g |

Chemical A:

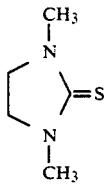

Dye solution: Obtained by dissolving 67 mg of the following dye (a) and 133 mg of the following dye (b) in 100 ml of methanol.

Dye (a)

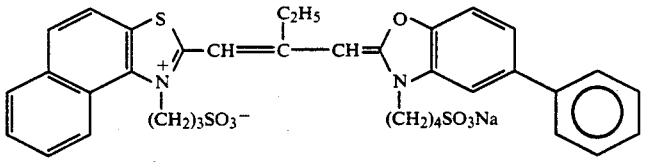

Dye (b)

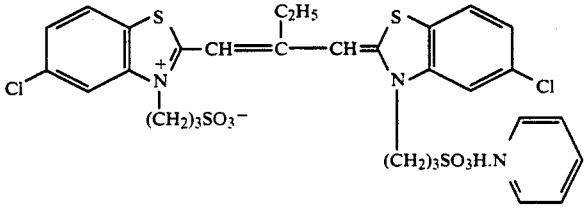

(2) Preparation of gelatin dispersions of dye-providing compounds

Yellow, magenta and cyan dye-providing compounds were each dissolved in 50 ml of ethyl acetate according to the compositions described later at a temperature of about 60° C. to obtain homogeneous solutions. These solutions were then mixed with 100 g of a 10% aqueous solution of lime-processed gelatin, 0.6 g of sodium dodecylbenzenesulfonate, and 50 ml of water with stirring. These solutions were subjected to dispersion in a homogenizer at 10,000 rpm over 10 minutes. The resulting dispersions were used as gelatin dispersions of dye-providing compounds.

| | Yellow | Magenta | Cyan |
|---|---|---|---|
| Dye-providing compound set forth below | (1) 13 g | (2) 15.5 g | (3) 16.6 g |
| Electron donor 1 set forth below | 10.2 g | 8.6 g | 8.1 g |
| High boiling solvent 2 set forth below | 6.5 g | 7.8 g | 8.3 g |
| Electron transfer agent 3 precursor set forth below | 0.4 g | 0.7 g | 0.7 g |

Dye-providing compound (1)

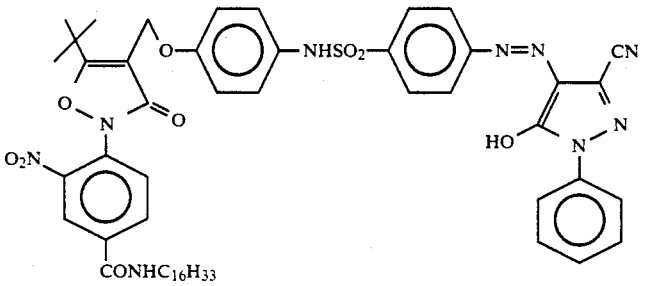

Dye-providing compound (2)

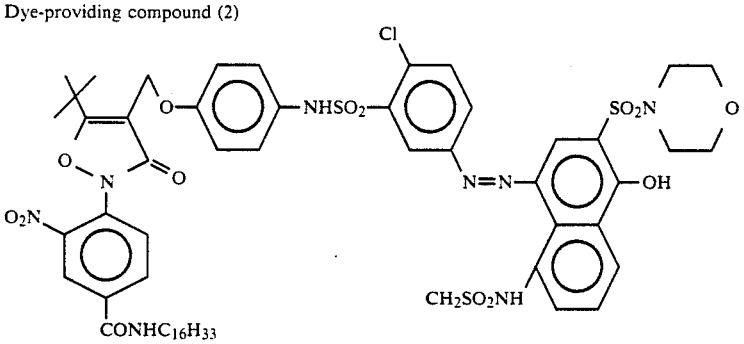

Dye-providing compound (3)

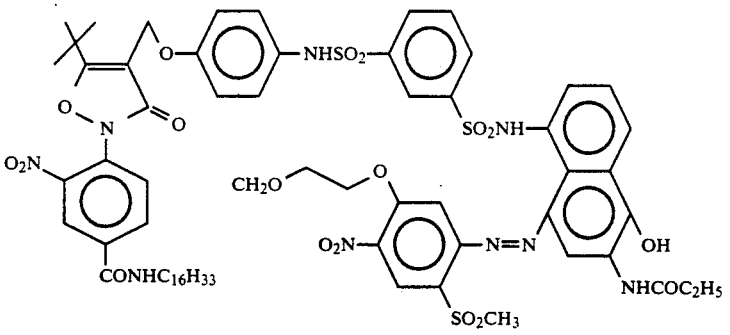

Electron donor 1

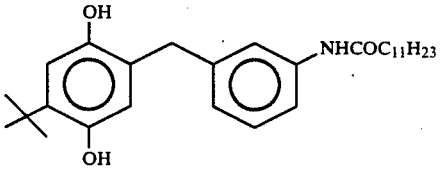

High-boiling solvent 2

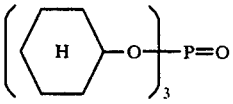

-continued

Electron transfer agent precursor 3

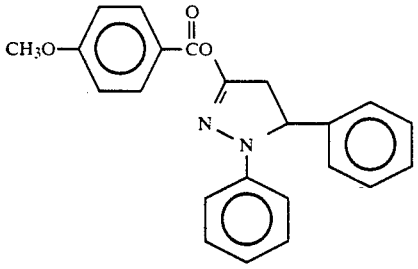

(3) Preparation of a gelatin dispersion of electron donor for interlayer

The preparation of a gelatin dispersion of an electron donor 4 for the interlayer will be described hereinafter.

23.6 g of the electron donor 4 set forth below and 8.5 g of the above mentioned high boiling solvent 2 were dissolved in 30 ml of ethyl acetate to obtain a homogeneous solution. The solution was then mixed with 100 g of a 10% aqueous solution of lime-processed gelatin, 0.25 g of sodium hydrogensulfide, 0.3 g of sodium dodecylbenzenesulfonate, and 30 ml of water with stirring. The mixture was then subjected to dispersion in a homogenizer at 10,000 rpm over 10 minutes. The resulting dispersion was used as a gelatin dispersion of electron donor 4.

Electron donor 4

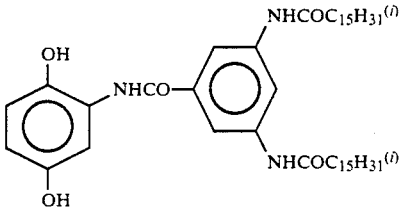

(4) Preparation of a dispersion of zinc hydroxide 12.5 g of zinc hydroxide grains having an average size of 0.2 μm, 1 g of carboxymethyl cellulose as dispersant, and 0.1 g of sodium polyacrylate were added to 100 ml of a 4% aqueous solution of gelatin. The mixture was then subjected to grinding in a mill with glass beads having an average grain size of 0.75 mm over 30 minutes. The glass beads were removed to obtain a dispersion of zinc hydroxide.

(5) Preparation of a dispersion of activated carbon 2.5 g of activated carbon powder available from Wako Junyaku K.K. (guaranteed reagent), 1 g of Demol N (Kao Corporation) as dispersant, and 0.25 g of polyethylene glycol nonylphenyl ether were added to 100 ml of a 5% aqueous solution of gelatin. The mixture was then subjected to grinding in a mill with glass beads having an average grain size of 0.75 mm over 120 minutes. The glass beads were removed to obtain a dispersion of activated carbon having an average diameter of 0.5 μm.

(6) Preparation of a dispersion of electron transfer agent 10 g of an electron transfer agent set forth below, 0.5 g of polyethylene glycol nonylphenyl ether as dispersant, and 0.5 g of an anionic surface active agent set forth below were added to 100 g of a 5% aqueous solution of gelatin. The mixture was then subjected to grinding in a mill with glass beads having an average grain size of 0.75 mm over 60 minutes. The glass beads were removed to obtain a dispersion of electron transfer agent having an average grain diameter of 0.3 μm.

Electron transfer agent

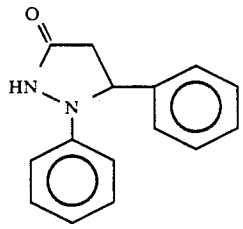

Anionic surface active agent

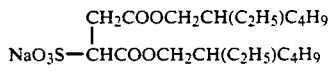

A multilayer heat-developable light-sensitive material 1 was prepared from these materials as set forth in Table 7.

TABLE 7

Structure of Light-sensitive Material 1

| Layer No. | Layer name | | Coated amount (mg/m²) |
|---|---|---|---|
| 6th layer | Protective layer | Gelatin | 900 |
| | | Silica (size: 4 μm) | 40 |
| | | Zinc hydroxide | 600 |
| | | Surface active agent 5 (Note 1) | 130 |
| | | Surface active agent 6 (Note 2) | 26 |
| | | Water-soluble polymer (Note 3) | 8 |
| 5th layer | Blue-sensitive emulsion layer | Light-sensitive silver halide emulsion layer (I) | 380 (as calculated in terms of silver) |
| | | Yellow dye-providing compound (1) | 400 |
| | | Gelatin | 600 |
| | | Electron donor 1 | 308 |
| | | High boiling solvent 2 | 200 |
| | | Electron tranfer agent precursor 3 | 15 |
| | | Zinc hydroxide | 330 |
| | | Surface active agent 7 (Note 5) | 18 |
| | | Water-soluble polymer (Note 3) | 13 |
| 4th | Interlayer | Gelatin | 700 |

TABLE 7-continued

| | | | |
|---|---|---|---|
| layer | | Electron donor 4 | 130 |
| | | High boiling solvent 2 | 48 |
| | | Surface active agent 6 (Note 2) | 15 |
| | | Surface active agent 8 (Note 6) | 61 |
| | | Surface active agent 7 (Note 5) | 2 |
| | | Electron transfer agent 8 (Note 7) | 27 |
| | | Electron transfer agent 9 (Note 8) | 36 |
| | | Water-soluble polymer (Note 3) | 19 |
| | | Hardening agent 10 (Note 9) | 37 |
| 3rd layer | Green-sensitive emulsion layer | Light-sensitive silver halide emulsion layer (II) | 220 (as calculated in terms of silver) |
| | | Magenta dye-providing compound (2) | 365 |
| | | Gelatin | 310 |
| | | Electron donor 1 | 158 |
| | | High boiling solvent 2 | 183 |
| | | Electron transfer agent precursor 3 | 15 |
| | | Electron transfer agent 8 (Note 7) | 27 |
| | | Surface active agent 7 (Note 5) | 13 |
| | | Water-soluble polymer (Note 3) | 11 |
| 2nd layer | Interlayer | Gelatin | 790 |
| | | Zinc hydroxide | 300 |
| | | Electron donor 4 | 130 |
| | | High boiling solvent 2 | 73 |
| | | Surface active agent 7 (Note 5) | 2 |
| | | Surface active agent 8 (Note 6) | 100 |
| | | Surface active agent 6 (Note 2) | 11 |
| | | Water-soluble polymer (Note 3) | 12 |
| | | Activated carbon | 25 |
| 1st layer | Red-sensitive emulsion layer | Light-sensitive silver halide emulsion layer (III) | 230 (as calculated in terms of silver) |
| | | Cyan dye-providing compound (3) | 343 |
| | | Gelatin | 330 |
| | | Electron donor 1 | 163 |
| | | High boiling solvent 2 | 172 |
| | | Electron transfer agent Precursor 3 | 17 |
| | | Electron transfer agent 8 (Note 7) | 28 |
| | | Surface active agent 7 (Note 5) | 10 |
| | | Water-soluble polymer (Note 3) | 5 |
| Support: | Polyethylene terephthalate 96 μm (coated with carbon black on backing layer) | | |

(Note 1) Surface active agent 5

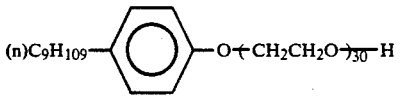

(Note 2) Surface active agent 6

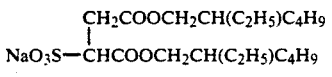

(Note 3) Water-soluble polymer

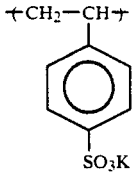

(Note 5) Surface active agent 7

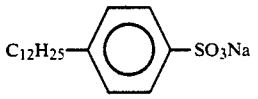

(Note 6) Surface active agent 8

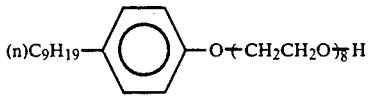

(Note 7) Electron transfer agent 8

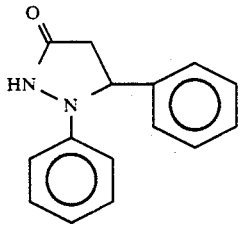

(Note 8) Electron transfer agent 9

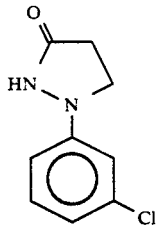

(Note 9) Hardening agent 10
1,2-Bis(vinylsulfonylacetamide)ethane

Comparative light-sensitive material Specimens 2 and 3 were prepared in the same manner as in Specimen 1 except that conventional antifogging agents were incorporated in the 1st layer, 3rd layer and 5th layer as set forth in Table 8. Light-sensitive material specimens 4 to 10 of the present invention were prepared in the same manner as in Specimen 1 except that the compounds of the present invention were incorporated therein as set forth in Table 8.

The antifogging agents A and B incorporated in Specimens 2 and 3 had the following formulae:

Antifogging agent A

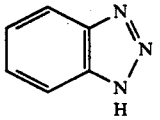

Antifogging agent B

-continued

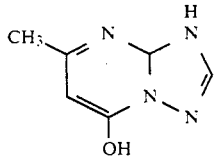

(7) Preparation of dye-fixing material

A dye-fixing material was prepared by coating various layers having the following compositions on a polyethylene-laminated paper support.

Structure of dye-fixing material

| Layer No. | Additive | Amount (g/m²) |
|---|---|---|
| 3rd layer | Gelatin | 0.05 |
| | Silicone oil (1) | 0.04 |
| | Surface active agent (1) | 0.001 |
| | Surface active agent (2) | 0.02 |
| | Surface active agent (3) | 0.10 |
| | Matting agent (1) | 0.02 |
| | Guanidine picrate | 0.45 |
| | Water-soluble polymer (1) | 0.24 |
| 2nd layer | Mordant (1) | 2.35 |
| | Water-soluble polymer (1) | 0.20 |
| | Gelatin | 1.40 |
| | Water-soluble polymer (2) | 0.60 |
| | High boiling solvent (1) | 1.40 |
| | Guanidine picrate | 2.25 |
| | Brightening agent (1) | 0.05 |
| | Surface active agent (5) | 0.15 |
| 1st layer | Gelatin | 0.45 |
| | Surface active agent (3) | 0.01 |
| | Water-soluble polymer (1) | 0.04 |
| | Hardening agent (1) | 0.30 |
| | Support (1) | |
| 1st backing layer | Gelatin | 3.25 |
| | Hardening agent (1) | 0.25 |
| 2nd backing layer | Gelatin | 0.44 |
| | Silicone oil (1) | 0.08 |
| | Surface active agent (4) | 0.04 |
| | Surface active agent (5) | 0.01 |
| | Matting agent (2) | 0.03 |

Structure of Support (1)

| Layer name | Composition | Film thickness (μm) |
|---|---|---|
| Surface subbing layer | Gelatin | 0.1 |
| Surface PE layer (glossy) | Low density polyethylene (density: 0.923): 89.2 parts surface-treated titanium oxide; 10.0 parts ultramarine; 0.8 part | 45.0 |
| Pulp layer | High quality paper (LBKP/NBKP = 1:1; density: 1.080) | 92.6 |
| Surface PE layer (mat) | High density polyethylene (density: 0.960) | 36.0 |
| Back subbing layer | Gelatin | 0.05 |
| | Colloidal silica | 0.05 |
| | Total | 173.8 |

Silicone oil (1)

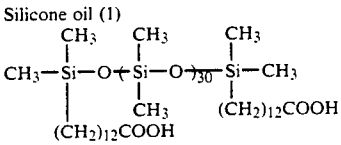

Surface active agent (1)

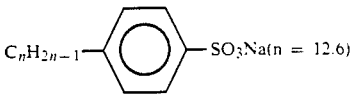

Surface active agent (2)

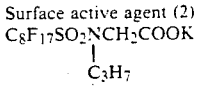

Surface active agent (3)

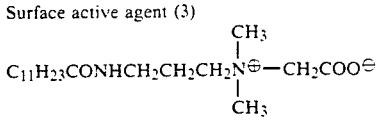

Surface active agent (4)

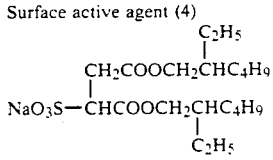

Brightening agent (1)
2,5-Bis(5-tertiary-butylbenzoxazole(2))thiophene

Surface active agent (5)

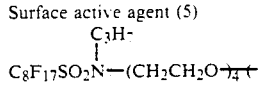

Water-soluble polymer (1)
Sumikagel L5-H (Sumitomo Chemical Co., Ltd.)

Water-soluble polymer (2)
Dextran (molecular weight: 70,000)

Mordant (1)

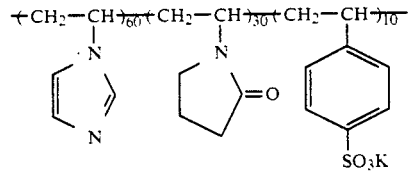

High boiling solvent (1)

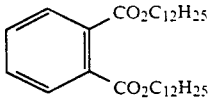

Hardening agent (1)

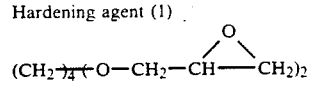

Matting agent (1)*
Silica
Matting agent (2)*
Benzoguanamine resin (average grain diameter: 15 μm)

These multilayer color light-sensitive materials were then exposed to light with 400 lux from a tungsten lamp through a B, G, R and gray separation filter having a gradual density over 1/10 second.

Water was then supplied to the emulsion surface of these heat-developable light-sensitive materials thus exposed by means of a wire bar in an amount of 15 ml/m² while the materials were being fed at a linear speed of 20 mm/sec. These light-sensitive materials were immediately laminated with the dye-fixing material in such a manner that the film surfaces thereof were brought into contact with each other.

These laminations were heated for 15 seconds over a heat roller which had been temperature-adjusted so that the temperature of the water-absorbed film reached 85° C. The dye-fixing material was then peeled off the light-sensitive materials to obtain blue, green, red, and gray images corresponding to the B, G, R and gray separation filters on the dye-fixing material.

These specimens were measured for the maximum densities ($D_{max}$) and minimum density ($D_{min}$) of cyan, magenta and yellow on the gray portion. The results are set forth in Table 8.

Another batch of these specimens were stored at a temperature of 40° C. and a relative humidity of 70% over 7 days, and then processed in the same manner as described above. These specimens were measured for $D_{max}$ and $D_{min}$ in the same manner as described above. The results are set forth in Table 9.

TABLE 8

| Light-sensitive material No. | Antifogging agent No. | Added amount (mg/m²) | Yellow $D_{min}$ | Yellow $D_{max}$ | Magenta $D_{min}$ | Magenta $D_{max}$ | Cyan $D_{min}$ | Cyan $D_{max}$ |
|---|---|---|---|---|---|---|---|---|
| 1 (Comparative) | — | — | 0.15 | 1.21 | 0.13 | 1.69 | 0.13 | 1.52 |
| 2 (Comparative) | A | 0.8 | 0.17 | 1.25 | 0.15 | 1.71 | 0.15 | 1.59 |
| 3 (Comparative) | B | 0.8 | 0.15 | 1.07 | 0.11 | 1.54 | 0.11 | 1.35 |
| 4 (Present Invention) | 1 | 0.7 | 0.17 | 2.08 | 0.15 | 2.42 | 0.16 | 2.23 |
| 5 (Present Invention) | 5 | 0.6 | 0.16 | 2.13 | 0.13 | 2.44 | 0.14 | 2.33 |
| 6 (Present Invention) | 8 | 0.7 | 0.16 | 1.91 | 0.14 | 2.41 | 0.15 | 2.19 |
| 7 (Present Invention) | 18 | 0.6 | 0.16 | 1.98 | 0.14 | 2.41 | 0.15 | 2.11 |
| 8 (Present Invention) | 27 | 0.7 | 0.15 | 2.00 | 0.13 | 2.40 | 0.14 | 2.18 |
| 9 (Present Invention) | 32 | 0.6 | 0.14 | 2.04 | 0.12 | 2.46 | 0.15 | 2.24 |
| 10 (Present Invention) | 36 | 0.6 | 0.15 | 1.95 | 0.13 | 1.46 | 0.11 | 2.21 |

TABLE 9

| Light-sensitive material No. | Yellow $D_{min}$ | Yellow $D_{max}$ | Magenta $D_{min}$ | Magenta $D_{max}$ | Cyan $D_{min}$ | Cyan $D_{max}$ |
|---|---|---|---|---|---|---|
| 1 (Comparative) | 0.14 | 1.01 | 0.12 | 1.49 | 0.12 | 1.32 |
| 2 (Comparative) | 0.20 | 1.03 | 0.17 | 1.50 | 0.17 | 1.30 |
| 3 (Comparative) | 0.17 | 0.81 | 0.13 | 1.22 | 0.13 | 1.11 |
| 4 (Present Invention) | 0.16 | 2.03 | 0.14 | 2.40 | 0.16 | 2.21 |
| 5 (Present Invention) | 0.16 | 2.12 | 0.13 | 2.38 | 0.13 | 2.30 |
| 6 (Present Invention) | 0.16 | 1.93 | 0.15 | 2.44 | 0.15 | 2.25 |
| 7 (Present Invention) | 0.15 | 1.97 | 0.14 | 2.42 | 0.15 | 2.01 |
| 8 (Present Invention) | 0.15 | 2.00 | 0.13 | 2.31 | 0.13 | 2.17 |
| 9 (Present Invention) | 0.15 | 2.06 | 0.13 | 2.40 | 0.15 | 2.30 |
| 10 (Present Invention) | 0.15 | 1.97 | 0.13 | 2.45 | 0.13 | 2.14 |

Table 8 shows that the light-sensitive material specimens comprising the compounds of the present invention exhibit high maximum densities. Table 9 shows that the light-sensitive material specimens exhibit a small change in density after storage.

While the invention has been described in detail and with reference to specific embodiments thereof, it will be apparent to one skilled in the art that various changes and modifications can be made therein without departing from the spirit and scope thereof.

What is claimed is:

1. A heat-developable silver halide photographic material, comprising a light-sensitive emulsion layer or other hydrophilic colloid layer containing a compound represented by formula (I);

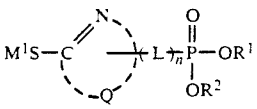

(I)

wherein Q represents a nonmetallic atomic group required to be connected to carbon atom and nitrogen atom to form a monocyclic or condensed heterocyclic ring therewith; L represents a divalent group selected from the group consisting of an alkylene group, an arylene group and a heteroarylene group, each of which may be substituted, and each of which may be alone or in combination with another divalent group selected from the group consisting of an ether bond, thioether bond, urethane bond, urea bond, ester bond, amide bond, sulfonamide bond, thiourea bond and carboxylic ester bond; n represents an integer of 0 to 2; $M^1$ represents a hydrogen atom, ammonium ion or metallic ion; and $R^1$ and $R^2$ each represents a hydrogen atom, alkyl group, ammonium ion or metallic ion and may be the same or different or may be connected to each other to form a 5- or 6-membered ring.

2. A heat developable silver halide photographic material as claimed in claim 1, wherein at least one of $R^1$ and $R^2$ represents a hydrogen atom, ammonium ion or metallic ion.

3. A heat developable silver halide photographic material as claimed in claim 1, wherein Q completes a monocyclic or condensed heterocyclic group selected from the group consisting of an imidazole ring, pyrazole ring, triazole ring, tetrazole ring, oxazole ring, thiazole ring, selenazole ring, tellurazole ring, oxadiazole ring, thiadiazole ring, pyridine ring, pyrazine ring, pyrimidine ring, benzimidazole ring, benzoxazole ring, benzothiazole ring, and azaindene.

4. A heat developable silver halide photographic material as claimed in claim 1, wherein $M^1$ is selected from the group consisting of a hydrogen atom, $NH_4\oplus$, $NH(C_2H_5)_3\oplus$, $N(C_2H_5)_4\oplus$, $Na\oplus$, $K\oplus$, $Ag\oplus$, $Li\oplus$, $Ca\oplus\oplus$, and $Zn\oplus\oplus$.

5. A heat developable silver halide photographic material as claimed in claim 1, wherein at least one of the heterocyclic group containing Q and the divalent group represented by L are provided with substituents selected from the group consisting of a hydrogen atom, nitro group, nitroso group, cyano group, carboxyl group, sulfo group, mercapto group, hydroxyl group, halogen atom, alkyl group, aralkyl group, alkenyl group, alkynyl group, aryl group, heterocyclic group, acyl group, sulfonyl group, amino group, alkoxy group, aryloxy group, heteroaryloxy group, alkylthio group, arylthio group, heteroarylthio group, ammonio group, carbamoyl group, sulfamoyl group, acylamino group, acyloxy group, suifonylamino group, alkoxycarbonylamino group, aryloxycarbonylamino group, alkoxycarbonyloxy group, aryloxycarbonyloxy group, aminocarbonylamino group, aminocarbonyloxy group, aminosulfonylamino group, sulfonyloxy group, and alkoxy or aryloxycarbonyl group, each of which may be further substituted.

6. A heat developable silver halide photographic material as claimed in claim 5, wherein each substitutent is comprised of no more than 10 carbon atoms.

7. A heat developable silver halide photographic material as claimed in claim 1, wherein the amount of said compound of formula (I) is present in amount of from $10^{-7}$ to $10^{-2}$ mol per mol of silver.

8. A heat developable silver halide photographic material as claimed in claim 1, wherein said material comprises said light-sensitive emulsion layer containing said compound of formula (I).

9. A heat developable silver halide photographic material as claimed in claim 1, wherein said material comprises said other hydrophilic colloid layer containing said compound of formula (I).

* * * * *